United States Patent [19]

Bunch et al.

[11] Patent Number: 5,021,327

[45] Date of Patent: Jun. 4, 1991

[54] RADIOGRAPHIC SCREEN/FILM ASSEMBLIES WITH IMPROVED DETECTION QUANTUM EFFICIENCIES

[75] Inventors: Phillip C. Bunch; Robert E. Dickerson, both of Rochester, N.Y.

[73] Assignee: Eastman Kodak Company, Rochester, N.Y.

[21] Appl. No.: 456,889

[22] Filed: Dec. 26, 1989

Related U.S. Application Data

[63] Continuation-in-part of Ser. No. 373,720, Jun. 29, 1989, abandoned, which is a continuation-in-part of Ser. No. 314,023, Feb. 23, 1989, abandoned.

[51] Int. Cl.[5] ..... G03C 1/46

[52] U.S. Cl. ..... 430/496; 430/502; 430/966; 430/403

[58] Field of Search ..... 430/403, 463, 466, 496, 430/502

[56] References Cited

U.S. PATENT DOCUMENTS

| | | | |
|---|---|---|---|
| 4,425,425 | 1/1984 | Abbott et al. | 430/502 |
| 4,425,426 | 1/1984 | Abbott et al. | 430/502 |
| 4,500,631 | 2/1985 | Sakamoto et al. | 430/413 |
| 4,639,411 | 1/1987 | Daubendiet et al. | 430/519 |
| 4,707,435 | 11/1987 | Lyons et al. | 430/494 |
| 4,710,637 | 12/1987 | Luckey et al. | 250/486 |
| 4,803,150 | 2/1989 | Dickerson et al. | 430/502 |

FOREIGN PATENT DOCUMENTS 0276497 3/1988 European Pat. Off. .

OTHER PUBLICATIONS

K. Rossman & G. Sanderson, "Validity of the Modulation Transfer Function of Radiographic Screen-Film Systems Measured by the Slit Method", *Phys. Med. Biol.*, 1968, vol. 13, No. 2, pp. 259-268.

*Research Disclosure,* vol. 184, Aug. 1979, Item 18431, Section V, Cross-Over Exposure Control.

*Primary Examiner*—Charles L. Bowers, Jr.
*Assistant Examiner*—Janet C. Baxter
*Attorney, Agent, or Firm*—Carl O. Thomas

[57] ABSTRACT

Assemblies of double coated radiographic elements exhibiting sharply curtailed crossover and front and back intensifying screen pairs are disclosed. By choosing a front screen that exceeds a stated sharpness criterion, expressed in terms of modulation transfer factors (MTF), and a back screen and adjacent emulsion layer unit combination exhibiting a photicity at least twice that of the combination of the front screen and its adjacent emulsion layer unit an enhancement in detective quantum efficiency (DQE) is realized.

17 Claims, 17 Drawing Sheets

RADIOGRAPHIC SCREEN/FILM ASSEMBLIES WITH IMPROVED DETECTION QUANTUM EFFICIENCIES

FIELD OF THE INVENTION

The invention relates to radiographic imaging. More specifically, the invention relates to assemblies of double coated silver halide radiographic elements and intensifying screen pairs.

BACKGROUND

In medical radiography an image of a patient's tissue and bone structure is produced by exposing the patient to X-radiation and recording the pattern of penetrating X-radiation using a radiographic element containing at least one radiation-sensitive silver halide emulsion layer coated on a transparent (usually blue tinted) film support. The X-radiation can be directly recorded by the emulsion layer where only low levels of exposure are required, as in dental imaging and the imaging of body extremities. However, a more efficient approach, which greatly reduces X-radiation levels required, is to employ an intensifying screen in combination with the radiographic element. The intensifying screen absorbs X-radiation and emits longer wavelength electromagnetic radiation which silver halide emulsions more readily absorb. Another technique for reducing patient exposure is to coat two silver halide emulsion layers on opposite sides of the film support to form a "double coated" radiographic element.

Diagnostic needs can be satisfied at the lowest patient X-radiation exposure levels by employing a double coated radiographic element in combination with a pair of intensifying screens. The silver halide emulsion layer unit on each side of the support directly absorbs about 1 to 2 percent of incident X-radiation. The front screen, the screen nearest the X-radiation source, absorbs a much higher percentage of X-radiation, but still transmits sufficient X-radiation to expose the back screen, the screen farthest from the X-radiation source. In the overwhelming majority of applications the front and back screens are balanced so that each absorbs about the same proportion of the total X-radiation. However, a few variations have been reported from time to time. A specific example of balancing front and back screens to maximize image sharpness is provided by Luckey et al U.S. Pat. No. 4,710,637. Lyons et al U.S. Pat. No. 4,707,435 discloses in Example 10 the combination of two proprietary screens, Trimax 2 TM employed as a front screen and Trimax 12F TM employed as a back screen. K. Rossman and G. Sanderson, "Validity of the Modulation Transfer Function of Radiographic Screen-Film Systems Measured by the Slit Method", Phys. Med. Biol., 1968, vol. 13, no. 2, pp. 250–268, report the use of unsymmetrical screen-film assemblies in which either the two screens had measurably different optical characteristics or the two emulsions had measurably different optical properties.

An imagewise exposed double coated radiographic element contains a latent image in each of the two silver halide emulsion units on opposite sides of the film support. Processing converts the latent images to silver images and concurrently fixes out undeveloped silver halide, rendering the film light insensitive. When the film is mounted on a view box, the two superimposed silver images on opposite sides of the support are seen as a single image against a white, illuminated background.

It has been a continuing objective of medical radiography to maximize the information content of the diagnostic image while minimizing patient exposure to X-radiation. In 1918 the Eastman Kodak Company introduced the first medical radiographic product that was double coated, and the Patterson Screen Company that same year introduced a matched intensifying screen pair for that product.

An art recognized difficulty with employing double coated radiographic elements in combination with intensifying screens as described above is that some light emitted by each screen passes through the transparent film support to expose the silver halide emulsion layer unit on the opposite side of the support to light. The light emitted by a screen that exposes the emulsion layer unit on the opposite side of the support reduces image sharpness. The effect is referred to in the art as crossover.

A variety of approaches have been suggested to reduce crossover, as illustrated by *Research Disclosure*, Vol. 184, August 1979, Item 18431, Section V. Cross-Over Exposure Control. *Research Disclosure* is published by Kenneth Mason Publications, Ltd., Dudley Annex, 21*a* North Street, Emsworth, Hampshire P010 7DQ, England. While some of these approaches are capable of entirely eliminating crossover, they either interfere with (typically entirely prevent) concurrent viewing of the superimposed silver images on opposite sides of the support as a single image, require separation and tedious manual reregistration of the silver images in the course of eliminating the crossover reduction medium, or significantly desensitize the silver halide emulsion. As a result, none of these crossover reduction approaches have come into common usage in the radiographic art. An example of a recent crossover cure teaching of this type is Bollen et al European published patent application 276,497, which interposes a reflective support between the emulsion layer units during imaging.

The most successful approach to crossover reduction yet realized by the art consistent with viewing the superimposed silver images through a transparent film support without manual registration of images has been to employ double coated radiographic elements containing spectrally sensitized high aspect ratio tabular grain emulsions or thin intermediate aspect ratio tabular grain emulsions, illustrated by Abbott et al U.S. Pat. No. 4,425,425 and 4,425,426, respectively. Whereas radiographic elements typically exhibited crossover levels of at least 25 percent prior to Abbott et al, Abbott et al provide examples of crossover reductions in the 15 to 22 percent range.

Still more recently Dickerson et al (I) U.S. Pat. No. 4,803,150 has demonstrated that by combining the teachings of Abbott et al with a processing solution decolorizable microcrystalline dye located between at least one of the emulsion layer units and the transparent film support less than 10 percent down to "zero" crossover levels can be realized. Since the technique used to determine crossover, single screen exposure of a double coated radiographic element, cannot distinguish between exposure of the emulsion layer unit on the side of the support remote from the screen caused by crossover and the exposure caused by direct absorption of X-radiation, "zero" crossover radiographic elements in reality embrace radiographic elements with a measured crossover (including direct X-ray absorption) of less than about 5 percent.

Dickerson et al (II) U.S. Ser. No. 217,727, filed July 8, 1988, now U.S. Pat. No. 4,900,652, adds to the teachings of Dickerson et al (I), cited above, specific selections of hydrophilic colloid coating coverages in the emulsion and dye containing layers to allow the "zero" crossover radiographic elements to emerge dry to the touch from a conventional rapid access processor in less than 90 seconds with the crossover reducing microcrystalline dye decolorized.

An art accepted measure of the imaging efficiency of a radiographic element is its detective quantum efficiency (DQE). DQE is the ratio of the noise introduced into the radiographic element due to spatial fluctuations in the incident X-radiation supplied on exposure and the noise exhibited by the image bearing radiographic element, which is a composite of the input noise and the noise generated by the radiographic element itself. A theoretically perfect radiographic element is one which contributes no additional noise to that received on exposure and therefore exhibits a DQE of unity. In practice all radiographic elements exhibit a DQE substantially less than unity.

The DQE of a radiographic element can be determined by making two direct noise measurements, measurement of the input noise power spectrum (NPSi) and measurement of the output noise power spectrum (NPSo), and by making a mathematical adjustment to account for the influence of system gain (image contrast) and image sharpness as a function of its spatial frequency (modulation transfer factor or MTF).

DQE can be expressed mathematically by the following equation:

$$DQE = \frac{NPSi\,[(\gamma)(MTF)]^2}{NPSo} \qquad \text{(E-I)}$$

where

NPSi is the input noise power spectrum,

NPSo is the output noise power spectrum, $\gamma$ is contrast, and

MTF is the modulation transfer factor at the spatial frequency of imaging being measured.

From equation E-I it is apparent that DQE is a dimensionless ratio of the input and output noise power spectra with adjustments for MTF and contrast, the latter being the ratio of density change ($\Delta D$) per log unit of exposure change ($\Delta$ log E, where E is exposure in meter-candle-seconds). When contrast is 1.0, contrast ceases to be a significant factor in DQE. However, MTF is always a significant factor reducing DQE, since MTF is always less than unity when any degree of imaging detail is being considered. MTF is unity only when the spatial frequency of the image is 0-i.e., there is no image detail present. MTF typically declines from unity to a small fraction over the image spatial frequency range of 0 to 10 cycles/mm. Stated qualitatively, the image noise introduced by the radiographic element increases progressively as finer imaging detail is considered.

While equation E-I has been presented for ease of visualization, the more common practice is to employ the term incident X-radiation fluence (Q) instead of NPSi, where $$Q = (\log_{10} e)^2 / NPSi \qquad \text{(E-II)}$$

($\log_{10}$ e) is 0.4343 and Q has the units quanta/mm$^2$. With the substitution of Q for NPSi, equation E-I takes the following form:

$$DQE = \frac{[(\log_{10} e)(\gamma)(MTF)]^2}{Q(NPSo)} \qquad \text{(E-III)}$$

One of the visualization advantages of employing Q in preference to NPSi flows from the fact that Q is proportional to E. Therefore, in the pilots below of log Q versus spatial frequencies in cycles per mm similar DQE profiles are obtained whether log Q or log E is employed as an ordinate.

DQE and its component terms are described and their use demonstrated by R. Shaw, "The Equivalent Quantum Efficiency of the Photographic Process", J. Photogr. Sci., 11, 199–204 (1963) and J. Dainty and R. Shaw, *Image Science*, Academic Press, London, 1976, especially pp. 152–189 and 276–319.

SUMMARY OF THE INVENTION

In one aspect this invention is directed to an imaging assembly comprised of a transparent film support, front and back silver halide emulsion layer units coated on opposite sides of the film support, a front and back pair of intensifying screens adjacent the front and back emulsion layer units, respectively, for absorbing exposures to X-radiation and emitting electromagnetic radiation having a wavelength longer than 300 nm to imagewise expose the front and back silver halide emulsion layer units, and means for reducing to less than 10 percent crossover of the longer than 300 nm wavelength electromagnetic radiation emitted from the front screen to the back emulsion layer unit and from the back screen to the front emulsion layer unit, the crossover reducing means being decolorized in less than 90 seconds during processing of the emulsion layers.

The assembly is characterized in that the back screen and back emulsion layer unit in combination exhibit a photicity at least twice that of the front screen and the front emulsion layer unit in combination and the front screen is chosen to exhibit modulation transfer factors greater than those of reference curve A in FIG. 2.

It has been discovered that the best imaging properties heretofore realized in low crossover double coated radiographic elements can be further improved in terms of measured detective quantum efficiencies when these elements are imagewise exposed by a front and back screen pair in which the front screen exhibits modulation transfer factors above a commonly encountered minimum level and the back screen emits at least twice the amount of light emitted by the front screen during exposure, assuming equal sensitivities of the front and back emulsion layer units. Stated more generally, to cover the possibility of unequal sensitivities by the front and back emulsion layer units, it has been discovered that improved detective quantum efficienceis can be realized when the photicity of the back screen and back emulsion layer unit in combination is at least twice the photicity of the front screen and front emulsion layer unit in combination. In direct comparisons of assemblies failing to satisfy the requirements of the invention significant to large increases in DQE have been observed to be produced by the assemblies of this invention over a wide range of imaging spatial frequencies and incident X-radiation fluences Q.

DESCRIPTION OF PREFERRED EMBODIMENTS

Figure 1:
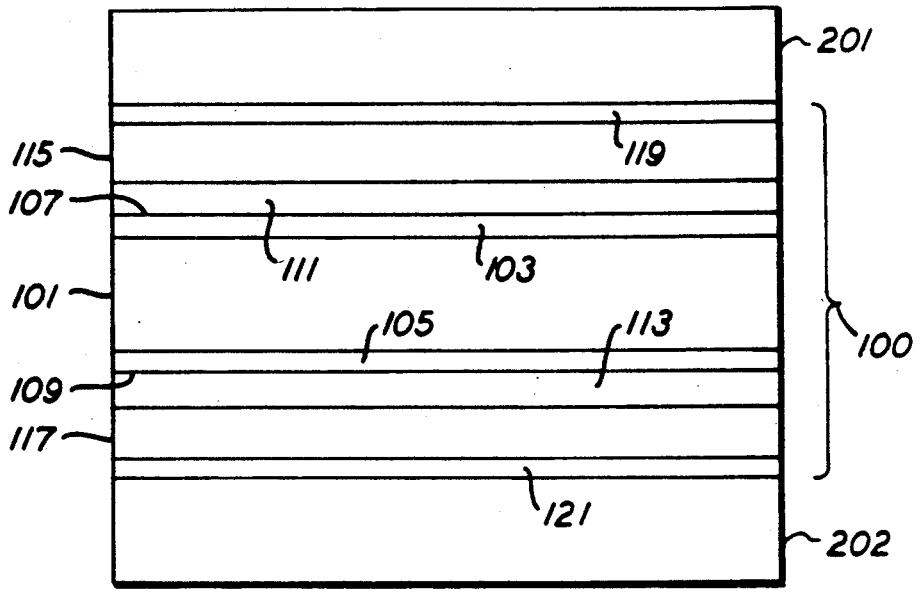
FIG. 1 is a schematic diagram of an assembly consisting of a double coated radiographic element sandwiched between two intensifying screens.

The radiographic imaging assemblies of the present invention are comprised of a transparent film support, front and back silver halide emulsion layer units coated on opposite sides of the film support, a front and back pair of intensifying screens adjacent the front and back emulsion layer units, respectively, for absorbing exposures to X-radiation and emitting electromagnetic radiation having a wavelength longer than 300 nm to imagewise expose the front and back silver halide emulsion layer units, and processing solution decolorizable means for reducing to less than 10 percent crossover of the longer than 300 nm wavelength electromagnetic radiation emitted from the front screen to the back emulsion layer unit and from the back screen to the front emulsion layer unit.

The intensifying screens can take any convenient conventional form, provided certain specific criteria are met. The front screen (the screen nearest the source of X-radiation during imaging) must exhibit modulation transfer factors (MTF) greater than those of reference curve A in FIG. 2. Modulation transfer factor measurement for screen-film radiographic systems is described by Kunio Doi et al, "MTF and Wiener Spectra of Radiographic Screen-Film Systems", U.S. Department of Health and Human Services, pamphlet FDA 82-8187. The profile of the individual modulation transfer factors over a range of cycles per mm constitutes a modulation transfer function.

These minimum MTF levels are well within the capabilities of commercial intensifying screens and therefore in themselves present no great restriction on front screen selection. However, because DQE declines with decreasing MTF (assuming a given X-ray absorption), as discussed above in connection with equations E-I and E-III, no practical purpose is served in attempting to improve DQE unless at least one of the two screens in the assembly is capable of satisfying the minimum MTF profile. In a preferred form of the invention both the front and back screens exhibit MTF's greater than those of curve A in FIG. 2. For the highest attainable levels of image sharpness it is specifically contemplated to employ front and back screens that satisfy the MTF profiles of curves A and B, respectively, of FIG. 3 of Luckey et al U.S. Pat. No. 4,710,637, the disclosure of which is here incorporated by reference.

In addition to containing at least a front intensifying screen which exceeds an objectively measurable MTF criterion, the front and back screens must satisfy a specific emission relationship on exposure. The back screen upon imagewise exposure of the assembly to X-radiation emits at least twice the longer than 300 nm electromagnetic radiation to which the emulsion layer units are responsive as compared to the front screen. While the emissions of the front and back screens can differ widely, depending upon the imaging application to be served and the specific choices of emulsion layer units, it is generally preferred that the back screen emission exceed that of the front screen by 2 to 10 times, optimally from about 2 to 4 times.

The foregoing relationships of front and back screen emissions assumes use of the screens in combination with symmetrical double coated radiographic elements-that is, radiographic elements which exhibit equal speeds of their front and back emulsion layer units. Conventional double coated radiographic elements are symmetrical.

Low crossover double coated radiographic elements containing front and back emulsion layer units that differ in speed are the specific subject matter of Dickerson et al (III) U.S. Ser. No. 314,341, filed Feb. 23, 1989, commonly assigned, titled RADIOGRAPHIC ELEMENTS WITH SELECTED SPEED RELATIONSHIPS now abandoned in favor of U.S. Ser. No. 385,114, filed July 26, 1989. Dickerson et al (III) demonstrates that an assembly containing such an unsymmetrical double coated radiographic element exhibits a markedly different contrast than other assemblies in which the same low crossover radiographic element is employed, but with differing screen selections.

Low crossover double coated radiographic elements containing front and back layer units that differ in contrast are the specific subject matter of Dickerson et al (IV) U.S. Ser. No. 314,339, filed Feb. 23, 1989, commonly assigned, titled RADIOGRAPHIC ELEMENTS WITH SELECTED CONTRAST RELATIONSHIPS now abandoned in favor of U.S. Ser. No. 385,128, filed July 26, 1989, which was in turn abandoned in favor of U.S. Ser. No. 502,220, filed Mar. 20, 1990. Dickerson et al (IV) demonstrates that an assembly containing a front emulsion layer unit exhibiting a contrast of $<2$ and a back emulsion layer unit exhibiting a contrast of at least 2.5 produces superior levels of contrast over a 1.0 log E exposure range, which is sufficient to obtain both heart and lung image detail in a single radiograph.

The assemblies of the present invention embrace those that contain either symmetrical or unsymmetrical low crossover double coated radiographic elements. It is specifically contemplated to form assemblies satisfying the requirements of this invention which include unsymmetrical radiographic elements of the types disclosed by Dickerson III and IV, cited above.

When the possibility of practicing the invention with unsymmetrical double coated radiographic elements is contemplated, not only are the relative emissions of the front and back screens significant, but the relative speeds of the front and back emulsion layer units must be taken into account. Thus, the general relationship of interest, applicable to both symmetrical and unsymmetrical double coated radiographic elements, is the relationship of the photicity of the back screen back emulsion layer unit combination to the photicity of the front screen front emulsion layer unit combination. The photicity of each screen and the emulsion layer unit it exposes is the integrated product of (1) the total emission of the screen over the wavelength range to which the emulsion layer is responsive, (2) the sensitivity of the emulsion layer unit over this emission range, and (3) the transmittance of radiation between the screen and its adjacent emulsion layer unit over this emission range. Transmittance is typically near unity and can in this instance be ignored. Photicity is discussed in greater detail in Mees, *The Theory of the Photographic Process*, 3rd Ed., Macmillan, 1966, at page 462, here incorporated by reference.

More generally stated, the assemblies of this invention require the photicity of the back screen in combination with the back emulsion layer unit of the double coated radiographic element to be at least twice the photicity of the front screen in combination with the front emulsion layer unit. Preferably the back screen in combination with the back emulsion layer unit exhibits a photicity which is in the range of from 2 to 10 times, optimally from about 2 to 4 times, that of the front screen in combination with the front emulsion layer unit. Since in most instances the double coated radiographic element is symmetrical (i.e., the speeds of the front and back emulsion layer units are identical), the relative photicities of the front and back combinations are the same as the relative emissions of the front and back screens. Therefore, the invention is discussed below in terms of relative front and back screen emissions, but it is to be understood that these emission comparisons are in reality photicity comparisons for symmetrical double coated radiographic elements.

It is apparent that increasing or decreasing the speed of the back emulsion layer unit in relation to the speed of the front emulsion layer unit can be relied upon to modulate front and back relative photicities. Where the speed of the back emulsion layer unit is less than that of the front emulsion layer unit, the emission of the back screen can be increased in relation to the emission of the front screen to compensate for this difference. Similarly, increasing the speed of the back emulsion layer unit can be used to compensate for a difference in front and back screen emissions below the desired difference in relative photicities. In the extreme, the emissions of the front and back screens can be equal or even slightly reversed in their relative strengths with the speeds of the front and back emulsion layer units being adjusted to still provide the desired relationship of front and back photicities.

Assemblies according to the present invention can contain front and back emulsion layer units that exhibit the same contrast or differ in contrast. When the emulsion layer units differ in contrast, it is preferred that the front emulsion layer unit exhibit the lower contrast. For enhancing useful contrasts over a 1.0 log E exposure range it is preferred that the front emulsion layer unit exhibit a contrast of $<2.0$ and that the back emulsion layer unit exhibit a contrast of at least 2.5. For extending exposure latitude it is preferred that the front and back emulsion layer units exhibit a contrast differing by 0.5 to 2.0, optimally from 1.0 to 1.5.

Customarily sensitometric characterizations of double coated radiographic elements generate characteristic (density vs. log exposure) curves that are the sum of two identical emulsion layer units, one coated on each of the two sides of the transparent support. Therefore, to keep speed and other sensitometric measurements (minimum density, contrast, maximum density, etc.) as compatible with customary practices as possible, the speed and other sensitometric characteristics of the front silver halide emulsion layer unit are determined with the front silver halide emulsion unit replacing the back silver halide emulsion unit to provide an arrangement with the front silver halide emulsion unit present on both sides of the transparent support. The speed and other sensitometric characteristics of the back silver halide emulsion layer unit are similarly determined with the back silver halide emulsion unit replacing the front silver halide emulsion unit to provide an arrangement with the back silver halide emulsion unit present on both sides of the transparent support. While speed is measured at 1.0 above minimum density, it is recognized that this is an arbitrary selection point, chosen simply because it is typical of art speed measurements. For nontypical characteristic curves (e.g., direct positive imaging or unusual curve shapes) another speed reference point can be selected.

The double coated radiographic elements of this invention offer the capability of producing superimposed silver images capable of transmission viewing which can satisfy the highest standards of the art in terms of speed and sharpness. At the same time the radiographic elements are capable of producing a wide range of contrasts merely by altering the choice of intensifying screens employed in combination with the radiographic elements.

This is achieved by constructing the radiographic element with a transparent film support and front and back emulsion layer units coated on opposite sides of the support. This allows transmission viewing of the silver images on opposite sides of the support after exposure and processing.

Between the emulsion layer units on opposite sides of the support, means are provided for reducing to less than 10 percent crossover of electromagnetic radiation of wavelengths longer than 300 nm capable of forming a latent image in the silver halide emulsion layer units. In addition to having the capability of absorbing longer wavelength radiation during imagewise exposure of the emulsion layer units the crossover reducing means must also have the capability of being decolorized in less than 90 seconds during processing, so that no visual hindrance is presented to viewing the superimposed silver images.

The crossover reducing means decreases crossover to less than 10 percent, preferably to less than 5 percent, and optimally to less than 3 percent. However, it must be kept in mind that for crossover measurement convenience the crossover percent being referred to also includes "false crossover", apparent crossover that is actually the product of direct X-radiation absorption. That is, even when crossover of longer wavelength radiation is entirely eliminated, measured crossover will still be in the range of 1 to 2 percent, attributable to the X-radiation that is directly absorbed by the emulsion farthest from the intensifying screen. Crossover percentages are determined by the procedures set forth in Abbott et al U.S. Pat. Nos. 4,425,425 and 4,425,426.

By reducing or eliminating crossover and employing intensifying screens differing in speed, independent radiographic records are formed in a single double coated radiographic element, resulting in improved detection quantum efficiencies.

The remaining features of the double coated radiographic elements not discussed above can take any convenient conventional form. In a specifically preferred form of the invention the advantages of (1) tabular grain emulsions as disclosed by Abbott et al U.S. Pat. Nos. 4,425,425 and 4,425,426, cited above and here incorporated by reference, hereinafter referred to as T-Grain TM emulsions; (2) sharpness levels attributable to crossover levels of less than 10 percent, (3) crossover reduction without emulsion desensitization or residual stain, and (4) the capability of rapid access processing, are realized in addition to the advantages discussed above.

These additional advantages can be realized by selecting the features of the double coated radiographic element of this invention according to the teachings of Dickerson et al (I) and/or (II), cited above. The following represents a specific preferred selection of features:

Referring to FIG. 1, in the assembly shown a radiographic element 100 according to this invention is positioned between a pair of light emitting intensifying screens 201 and 202. The radiographic element support is comprised of a transparent radiographic support element 101, typically blue tinted, capable of transmitting light to which it is exposed and optionally, similarly transmissive under layer units 103 and 105. On the first and second opposed major faces 107 and 109 of the support formed by the under layer units are crossover reducing hydrophilic colloid layers 111 and 113, respectively. Overlying the crossover reducing layers 111 and 113 are light recording latent image forming silver halide emulsion layer units 115 and 117, respectively. Each of the emulsion layer units is formed of one or more hydrophilic colloid layers including at least one silver halide emulsion layer. Overlying the emulsion layer units 115 and 117 are optional hydrophilic colloid protective overcoat layers 119 and 121, respectively. All of the hydrophilic colloid layers are permeable to processing solutions.

In use, the assembly is imagewise exposed to X radiation. The X radiation is principally absorbed by the intensifying screens 201 and 202, which promptly emit light as a direct function of X ray exposure. Considering first the light emitted by screen 201, the light recording latent image forming emulsion layer unit 115 is positioned adjacent this screen to receive the light which it emits. Because of the proximity of the screen 201 to the emulsion layer unit 115 only minimal light scattering occurs before latent image forming absorption occurs in this layer unit. Hence light emission from screen 201 forms a sharp image in emulsion layer unit 115.

However, not all of the light emitted by screen 201 is absorbed within emulsion layer unit 115. This remaining light, unless otherwise absorbed, will reach the remote emulsion layer unit 117, resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201. In an exactly analogous manner the screen 202 produces a sharp image in emulsion layer unit 117, and the light absorbing layers 111 and 113 similarly reduce crossover exposure of the emulsion layer unit 115 by the screen 202.

Following exposure to produce a stored latent image, the radiographic element 100 is removed from association with the intensifying screens 210 and 202 and processed in a rapid access processor-that is, a processor, such as an RP-X-Omat TM processor, which is capable of producing a image bearing radiographic element dry to the touch in less than 90 seconds. Rapid access processors are illustrated by Barnes et al U.S. Pat. No. 3,545,971 and Akio et al published European Patent Application No. 248,390.

Since rapid access processors employed commercially vary in their specific processing cycles and selections of processing solutions, the preferred radiographic elements satisfying the requirements of the present invention are specifically identified as being those that are capable of emerging dry to the touch when processed in 90 seconds according to the following reference conditions:

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to 4.5. | |

The preferred radiographic elements of the present invention make possible the unique combination of advantages set forth above by employing (1) substantially optimally spectrally sensitized tabular grain emulsions in the emulsion layer units to reach low crossover levels while achieving the high covering power and other known advantages of tabular grain emulsions, (2) one or more particulate dyes in the interlayer units to further reduce crossover to less than 10 percent without emulsion desensitization and minimal or no residual dye stain, and (3) hydrophilic colloid swell and coverage levels compatible with obtaining uniform coatings, rapid access processing, and reduced or eliminated wet pressure sensitivity. Each of these features of the invention is discussed in more detail below:

Each under layer unit contains a processing solution hydrophilic colloid and a particulate dye. The total concentration of the microcrystalline dye in both under layer units is sufficient to reduce the crossover of the radiographic element below 10 percent. This can be achieved when the concentration of the dye is chosen to impart to the structure separating the emulsion layer units an optical density of at least 2.00 at the peak wavelength of emulsion sensitivity. Although the dye can be unequally distributed between the two under layer units, it is preferred that each under layer unit contain sufficient dye to raise the optical density of that under layer unit to 1.00. Using the latter value as a point of reference, since it is conventional practice to employ intensifying screen-radiographic element combinations in which the peak emulsion sensitivity matches the peak light emission by the intensifying screens, it follows that the dye also exhibits a density of at least 1.00 at the wavelength of peak emission of the intensifying screen. Since neither screen emissions nor emulsion sensitivities are confined to a single wavelength, it is preferred to choose particulate dyes, including combinations of particulate dyes, capable of imparting a density of 1.00 or more over the entire spectral region of significant sensitivity and emission. For radiographic elements to be used with blue emitting intensifying screens, such as those which employ calcium tungstate or thulium activated lanthanum oxybromide phosphors, it is generally preferred that the particulate dye be selected to produce an optical density of at least 1.00 over the entire spectral region of 400 to 500 nm. For radiographic elements intended to be used with green emitting intensifying screens, such as those employing rare earth (e.g., terbium) activated gadolinium oxysulfide or oxyhalide phosphors, it is preferred that the particulate dye exhibit a density of at least 1.00 over the spectral region of 450 to 550 nm. To the extent the wavelength of emission of the screens or the sensitivities of the emulsion layers are restricted, the spectral region over which the particulate dye must also effectively absorb light is correspondingly reduced.

While particulate dye optical densities of 1.00, chosen as described above, are effective to reduce crossover to less than 10 percent, it is specifically recognized that particulate dye densities can be increased until radiographic element crossover is effectively eliminated. For example, by increasing the particulate dye concentration so that it imparts a density of 2.0 to the radiographic element, crossover is reduced to only 1 percent.

Since there is a direct relationship between the dye concentration and the optical density produced for a given dye or dye combination, precise optical density selections can be achieved by routine selection procedures. Because dyes vary widely in their extinction coefficients and absorption profiles, it is recognized that the weight or even molar concentrations of particulate dyes will vary from one dye or dye combination selection to the next.

The size of the dye particles is chosen to facilitate coating and rapid decolorization of the dye. In general smaller dye particles lend themselves to more uniform coatings and more rapid decolorization. The dye particles employed in all instances have a mean diameter of less than 10.0 μm and preferably less than 1.0 μm. There is no theoretical limit on the minimum sizes the dye particles can take. The dye particles can be most conveniently formed by crystallization from solution in sizes ranging down to about 0.01 μm or less. Where the dyes are initially crystallized in the form of particles larger than desired for use, conventional techniques for achieving smaller particle sizes can be employed, such as ball milling, roller milling, sand milling, and the like.

An important criterion in dye selection is their ability to remain in particulate form in hydrophilic colloid layers of radiographic elements. While the hydrophilic colloids can take any of various conventional forms, such as any of the forms set forth in *Research Disclosure*, Vol. 176, December 1978, Item 17643, Section IX, Vehicles and vehicle extenders, here incorporated by reference, the hydrophilic colloid layers are most commonly gelatin and gelatin derivatives (e.g., acetylated or phthalated gelatin). To achieve adequate coating uniformity the hydrophilic colloid must be coated at a layer coverage of at least 10 mg/dm$^2$. Any convenient higher coating coverage can be employed, provided the total hydrophilic colloid coverage per side of the radiographic element does not exceed that compatible with rapid access processing. Hydrophilic colloids are typically coated as aqueous solutions in the pH range of from about 5 to 6, most typically from 5.5 to 6.0, to form radiographic element layers. The dyes which are selected for use in the practice of this invention are those which are capable of remaining in particulate form at those pH levels in aqueous solutions.

Dyes which by reason of their chromophoric make up are inherently ionic, such as cyanine dyes, as well as dyes which contain substituents which are ionically dissociated in the above-noted pH ranges of coating may in individual instances be sufficiently insoluble to satisfy the requirements of this invention, but do not in general constitute preferred classes of dyes for use in the practice of the invention. For example, dyes with sulfonic acid substituents are normally too soluble to satisfy the requirements of the invention. On the other hand, nonionic dyes with carboxylic acid groups (depending in some instances on the specific substitution location of the carboxylic acid group) are in general insoluble under aqueous acid coating conditions. Specific dye selections can be made from known dye characteristics or by observing solubilities in the pH range of from 5.5 to 6.0 at normal layer coating temperatures-e.g., at a reference temperature of 40° C.

Preferred particulate dyes are nonionic polymethine dyes, which include the merocyanine, oxonol, hemioxonol, styryl, and arylidene dyes.

The merocyanine dyes include, joined by a methine linkage, at least one basic heterocyclic nucleus and at least one acidic nucleus. The nuclei can be joined by an even number or methine groups or in so-called "zero methine" merocyanine dyes, the methine linkage takes the form of a double bond between methine groups incorporated in the nuclei. Basic nuclei, such as azolium or azinium nuclei, for example, include those derived from pyridinium, quinolinium, isoquinolinium, oxazolium, pyrazolium, pyrrolium, indolium, oxadiazolium, 3H- or 1H-benzoindolium, pyrrolopyridinium, phenanthrothiazolium, and acenaphthothiazolium quaternary salts.

Exemplary of the basic heterocyclic nuclei are those satisfying Formulae I and II.

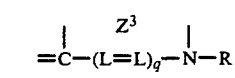

(I)

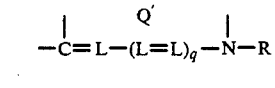

(II)

where $Z^3$ represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), oxadiazole, 2- or 4-pyridine, 2- or 4-quinoline, 1- or 3-isoquinoline, benzoquinoline, 1H- or 3H-benzoindole, and pyrazole, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 2-cyanoethyl, and trifluoromethyl), aryl groups or substituted aryl groups (e.g., phenyl, 1-naphthyl, 2-naphthyl, 3-carboxyphenyl, and 4-biphenylyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolylthio, and 2-naphthylthio), methylenedioxy, cyano, 2-thienyl, styryl, amino or substituted amino groups (e.g., anilino, dimethylamino, diethylamino, and morpholino), acyl groups, (e.g., formyl, acetyl, benzoyl, and benzenesulfonyl);

Q' represents the elements needed to complete a cyclic nucleus derived from basic heterocyclic nitrogen compounds such as pyrrole, pyrazole, indazole, and pyrrolopyridine;

R represents alkyl groups, aryl groups, alkenyl groups, or aralkyl groups, with or without substituents, (e.g., carboxy, hydroxy, sulfo, alkoxy, sulfato, thiosulfato, phosphono, chloro, and bromo substituents);

L is in each occurrence independently selected to represent a substituted or unsubstituted methine group-e.g., —$CR^8$=groups, where $R^8$ represents hydrogen when the methine group is unsubstituted and most commonly represents alkyl of from 1 to 4 carbon atoms or phenyl when the methine group is substituted; and q is 0 or 1.

Merocyanine dyes link one of the basic heterocyclic nuclei described above to an acidic keto methylene nucleus through a methine linkage, where the methine groups can take the form —$CR^8$=described above. The greater the number of the methine groups linking nuclei in the polymethine dyes in general and the merocyanine dyes in particular the longer the absorption wavelengths of the dyes.

Merocyanine dyes link one of the basic heterocyclic nuclei described above to an acidic keto methylene nucleus through a methine linkage as described above. Exemplary acidic nuclei are those which satisfy Formula III.

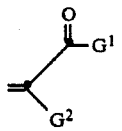

(III)

where $G^1$ represents an alkyl group or substituted alkyl group, an aryl or substituted aryl group, an aralkyl group, an alkoxy group, an aryloxy group, a hydroxy group, an amino group, or a substituted amino group, wherein exemplary substituents can take the various forms noted in connection with Formulae I and II;

$G^2$ can represent any one of the groups listed for $G^1$ and in addition can represent a cyano group, an alkyl, or arylsulfonyl group, or a group represented by

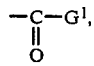

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl-2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)rhodanine, and 3-carboxymethylrhodanine, hydantoin (e.g., 1,3-diethylhydantoin and 3-ethyl-1-phenylhydantoin), 2-thiohydantoin (e.g., 1-ethyl-3-phenyl-2-thiohydantoin, 3-heptyl-1-phenyl-2-thiohydantoin, and arylsulfonyl-2-thiohydantoin), 2-pyrazolin-5-one, such as 3-methyl-1-phenyl-2-pyrazolin-5-one and 3-methyl-1-(4-carboxyphenyl)-2-pyrazolin-5-one, 2-isoxazolin-5-one (e.g., 3-phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione, 1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid).

Useful hemioxonol dyes exhibit a keto methylene nucleus as shown in Formula III and a nucleus as shown in Formula IV.

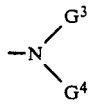

(IV)

where $G^3$ and $G^4$ may be the same or different and may represent alkyl, substituted alkyl, aryl, substituted aryl, or aralkyl, as illustrated for R ring substituents in Formula I or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4-tetrahydroquinoline, decahydroquinoline, 3-azabicyclo[3,2,2]nonane, indoline, azetidine, and hexahydroazepine.

Exemplary oxonol dyes exhibit two keto methylene nuclei as shown in Formula III joined through one or higher uneven number of methine groups.

Useful arylidene dyes exhibit a keto methylene nucleus as shown in Formula III and a nucleus as shown in Formula V joined by a methine linkage as described above containing one or a higher uneven number of methine groups.

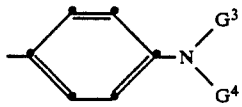

(V)

where $G^3$ and $G^4$ are as previously defined.

A specifically preferred class of oxonol dyes for use in the practice of the invention are the oxonol dyes disclosed in Factor and Diehl European published patent application No. 299,435. These oxonol dyes satisfy Formula VI.

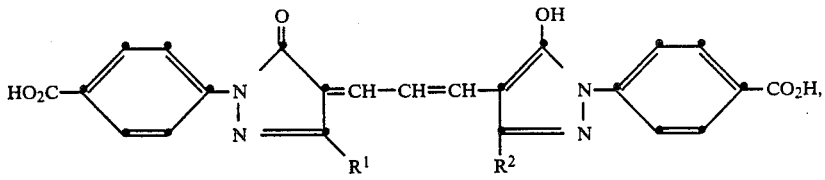

(VI)

wherein $R^1$ and $R^2$ each independently represent alkyl of from 1 to 5 carbon atoms.

A specifically preferred class of arylidene dyes for use in the practice of the invention are the arylidene dyes disclosed in Diehl and Factor European published patent application Nos. 274,723 and 294,461. These arylidene dyes satisfy Formula VII.

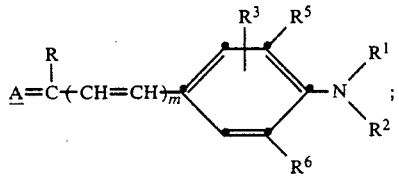

(VII)

wherein

A represents a substituted or unsubstituted acidic nucleus having a carboxyphenyl or sulfonamidophenyl substituent selected from the group consisting of 2-pryazolin-5-ones free of any substituent bonded thereto through a carboxyl group, rhodanines; hydantoins; 2-thiohydantoins; 4-thiohydantoins; 2,4-oxazolidindiones; 2-thio-2,4-oxazolidindiones; isoxazolinones; barbiturics; 2-thiobarbiturics and indandiones;

R represents hydrogen, alkyl of 1 to 4 carbon atoms or benzyl;

$R^1$ and $R^2$, each independently, represents alkyl or aryl; or taken together with $R^5$, $R^6$, N, and the carbon atoms to which they are attached represent the atoms needed to complete a julolidene ring;

$R^3$ represents H, alkyl or aryl;

$R^5$ and $R^6$, each independently, represents H or $R^5$ taken together with $R^1$; or $R^6$ taken together with $R^2$ each may represent the atoms necessary to complete a 5 or 6 membered ring; and m is 0 or 1.

Oxazole and oxazoline pyrazolone merocyanine particulate dyes of the type disclosed by Factor and Diehl U.S. Ser. No. 137,402, filed Dec. 23, 1987, commonly assigned, now U.S. Pat. No. 4,948,718 are also contemplated. These particulate dyes can be represented by Formula VIII.

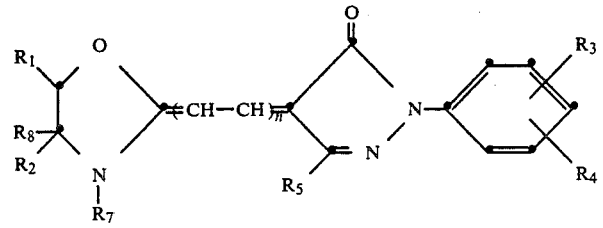

(VIII)

In Formula (I), $R_1$ and $R_2$ are each independently substituted or unsubstituted alkyl or substituted or unsubstituted aryl, or together represent the atoms necessary to complete a substituted or unsubstituted 5- or 6-membered ring.

$R_3$ and $R_4$ each independently represents H, substituted or unsubstituted alkyl, substituted or unsubstituted aryl, $CO_2H$, or $NHSO_2R_6$. $R_5$ is H, substituted or unsubstituted alkyl, substituted or unsubstituted aryl, carboxylate (i.e., COOR where R is substituted or unsubstituted alkyl), or substituted or unsubstituted acyl, $R_6$ and $R_7$ are each independently substituted or unsubstituted alkyl or substituted or unsubstituted aryl, and n is 1 or 2. $R_8$ is either substituted or unsubstituted alkyl, or is part of a double bond between the ring carbon atoms to which $R_1$ and $R_2$ are attached. At least one of the aryl rings of the dye molecule must have at least one substituent that is $CO_2H$ or $NHSO_2R_6$.

Oxazole and oxazoline benzoylacetonitrile merocyanine particulate dyes of the type disclosed by Factor and Diehl U.S. Ser. No. 290,602, filed Dec. 23, 1988, now U.S. Pat. No. 4,900,653, commonly assigned, are also contemplated. These particulate dyes can be represented by Formula IX.

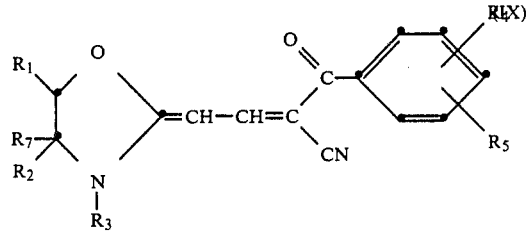

(IX)

In Formula IX, $R_1$, $R_2$, $R_3$, $R_4$, $R_5$, and $R_6$ may each be substituted or unsubstituted alkyl or substituted or unsubstituted aryl, preferably substituted or unsubstituted alkyl of 1 to 6 carbon atoms or substituted or unsubstituted aryl of 6 to 12 carbon atoms. $R_7$ may be substituted or unsubstituted alkyl of from 1 to 6 carbon atoms. The alkyl or aryl groups may be substituted with any of a number of substituents as is known in the art, other than those, such as sulfo substituents, that would tend to increase the solubility of the dye so much as to cause it to become soluble at coating pH's. Examples of useful substituents include halogen, alkoxy, ester groups, amido, acyl, and alkylamino. Examples of alkyl groups include methyl, ethyl, n-propyl, isopropyl, n-butyl, isobutyl, n-pentyl, n-hexyl, or isohexyl. Examples of aryl groups include phenyl, naphthyl, anthracenyl, pyridyl, and styryl.

$R_1$ and $R_2$ may also together represent the atoms necessary to complete a substituted or unsubstituted 5- or 6-membered ring, such as phenyl, naphthyl, pyridyl, cyclohexyl, dihydronaphthyl, or acenaphthyl. This ring may be substituted with substituents, other than those, such as sulfo substituents, that would tend to increase the solubility of the dye so much as to cause it to become soluble at coating pH's. Examples of useful substituents include halogen, alkyl, alkoxy, ester, amido, acyl, and alkylamino.

Useful bleachable particulate dyes can be found among a wide range of cyanine, merocyanine, oxonol, arylidene (i.e., merostyryl), anthraquinone, triphenylmethine, azo, azomethine, and other dyes, provided certain criteria are met identified in Diehl and Factor U.S. Ser. No. 137,495, filed Dec. 23, 1987, abandoned in favor of continuation-in-part U.S. Ser. No. 373,749, filed June 30, 1989, now U.S. Pat. No. 4,940,654, commonly assigned. Such dyes satisfy Formula X.

$$[D-(A)_y]-X_n \qquad (X)$$

where D is a chromophoric light-absorbing compound, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 8 or above.

Synthesis of the particulate dyes can be achieved by procedures known in the art for the synthesis of dyes of the same classes. For example, those familiar with techniques for dye synthesis disclosed in "*The Cyanine Dyes and Related Compounds*", Frances Hamer, Interscience Publishers, 1964, could readily synthesize the cyanine, merocyanine, merostyryl, and other polymethine dyes. The oxonol, anthraquinone, triphenylmethane, azo, and azomethine dyes are either known dyes or substituent variants of known dyes of these classes and can be synthesized by known or obvious variants of known synthetic techniques forming dyes of these classes. Specific illustrations of dye preparations are incorporated in the Appendix of Dickerson et al U.S. Pat. No. 4,803,150, here incorporated by reference.

Examples of particulate bleachable dyes useful in the practice of this invention include the following:

TABLE I

Trimethine Pyrazolone Cinnamylidene Dyes
General Structure:

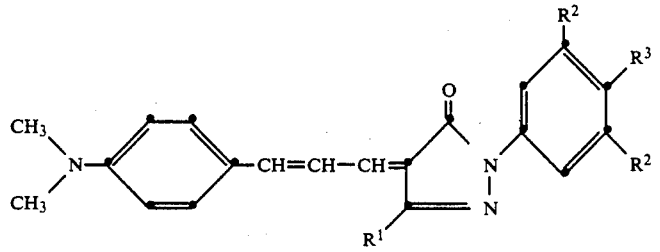

| Dye | $R^1$ | $R^2$ | $R^3$ | λ-max | ε-max (× $10^4$) (methanol) |
|---|---|---|---|---|---|
| 1 | $CH_3$ | H | $CO_2H$ | 516 | 4.62 |
| 2 | $CH_3CO$ | H | $CO_2H$ | 573 | 5.56 |
| 3 | $CO_2Et$ | H | $CO_2H$ | 576 | 5.76 |
| 4 | $CH_3$ | $CO_2H$ | H | 506 | 3.90 |
| 5 | $CO_2Et$ | $CO_2H$ | H | 560 | 5.25 |

TABLE II

Benzoylacetonitrile Merocyanine Dyes
General Structure:

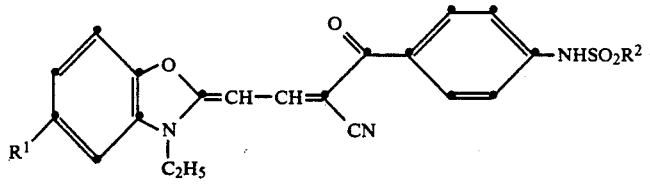

| Dye | $R^1$ | $R^2$ | λ-max | ε-max (× $10^4$) (methanol) |
|---|---|---|---|---|
| 6 | n-$C_6H_{13}SO_2NH$ | $CH_3$ | 445 | 7.32 |
| 7 | $CH_3SO_2NH$ | $C_3H_7$ | 446 | 7.86 |
| 8 | $CH_3SO_2NH$ | n-$C_6H_{13}$ | 447 | 7.6 |
| 9 | H | $CH_3$ | 449 | 6.5 |

TABLE II-A

Arylidene Dyes

TABLE II-A-continued

General Structure:

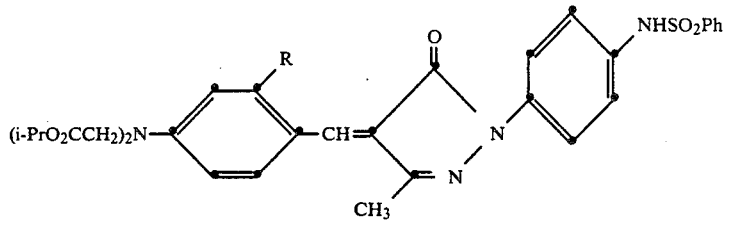

| Dye | R | λ-max | ε-max (× $10^4$) (methanol) |
|---|---|---|---|
| 10 | H | 424 | 3.98 |
| 11 | $CH_3$ | 423 | 3.86 |

TABLE III

Benzoylacetonitrile Arylidene Dyes
General Structure:

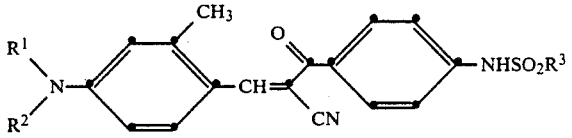

| Dye | $R^1$ | $R^2$ | $R^3$ | λ-max | ε-max (× $10^4$) (methanol) |
|---|---|---|---|---|---|
| 12 | i-$PrO_2CCH_2$ | i-$PrO_2CCH_2$ | $C_3H_7$ | 426 | 3.5 |
| 13 | $C_2H_5$ | $CF_3CH_2O_2CCH_2$ | $CH_3$ | 439 | 4.27 |
| 14 | i-$PrO_2CCH_2$ | i-$PrO_2CCH_3$ | $CH_3$ | 420 | 4.2 |
| 15 | $C_2H_5$ | $CF_3CH_2O_2CCH_2$ | $C_3H_7$ | 430 | 4.25 |

TABLE V

Barbituric Acid Merocyanines Dyes
General Structure:

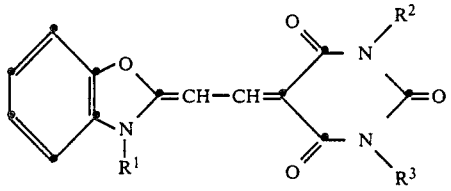

| Dye | $R^1$ | $R^2$ | $R^3$ | λ-max | ε-max (× $10^4$) (methanol) |
|---|---|---|---|---|---|
| 19 | $CH_2PhCO_2H$ | $C_2H_5$ | $C_2H_5$ | 442 | 10.70 |

TABLE IV

Pyrazolone Merocyanines Dyes
General Structure:

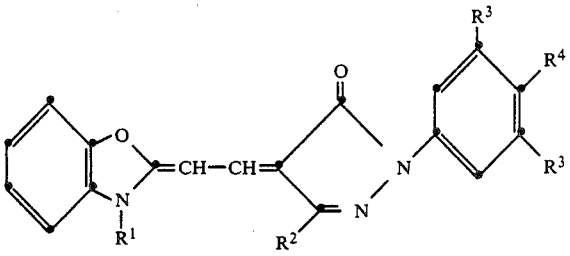

| Dye | $R^1$ | $R^2$ | $R^3$ | $R^4$ | λ-max | εmax (× $10^4$) (methanol) |
|---|---|---|---|---|---|---|
| 16 | $C_2H_5$ | $CH_3$ | H | $CO_2H$ | 450 | 7.4 |
| 17 | $C_2H_5$ | $CH_3$ | $CO_2H$ | H | 452 | 7.19 |

18

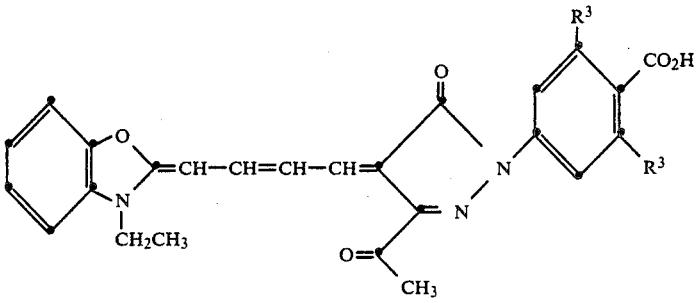

λ-max 562 nm (methanol) ε-max = 11.9 × $10^4$

TABLE VI

Benzoxazole Benzoylacetonitrile Merocyanine Dyes
General Structure:

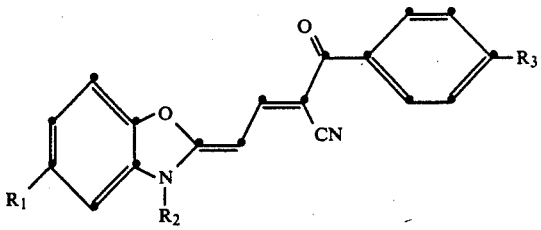

| Dye | $R^1$ | $R^2$ | $R^3$ |
|---|---|---|---|
| 20 | — | Et | $MeOEtSO_2NH$ |
| 21 | — | Me | $MeSO_2NH$ |
| 22 | $MeOEtSO_2NH$ | Et | $MeOEtSO_2NH$ |
| 23 | $MeOEtSO_2NH$ | Et | $HexSO_2NH$ |
| 24 | $MeSO_2NH$ | MeOEt | $MeSO_2NH$ |
| 25 | — | $CH_2PhCO_2H$ | $PrSO_2NH$ |
| 26 | $MeSO_2NH$ | MeOEt | $PrSO_2NH$ |
| 27 | $MeOEtSO_2NH$ | MeOEt | $PrSO_2NH$ |
| 28 | $EtSO_2NH$ | Et | $MeSO_2NH$ |
| 29 | $EtSO_2NH$ | Me | $MeSO_2NH$ |
| 30 | $MeOEtSO_2NH$ | MeOEt | $MeOEtSO_2NH$ |
| 31 | $HexSO_2NH$ | MeOEt | $MeSO_2NH$ |
| 32 | $MeOEtSO_2NH$ | MeOEt | $HexSO_2NH$ |
| 33 | — | $CH_2PhCO_2H$ | $MeSO_2NH$ |

TABLE VI-continued

Benzoxazole Benzoylacetonitrile Merocyanine Dyes
General Structure:

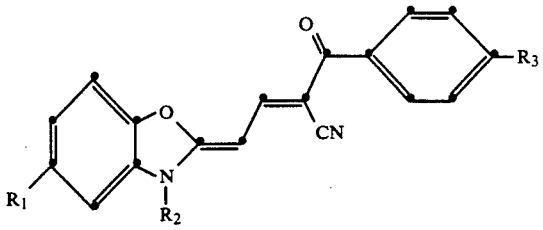

| Dye | $R^1$ | $R^2$ | $R^3$ |
|---|---|---|---|
| 34 | $MeSO_2NH$ | Me | $MeSO_2NH$ |
| 35 | $CO_2H$ | Me | $MeSO_2NH$ |
| 36 | $CO_2H$ | Me | $PrSO_2NH$ |
| 37 | $EtOEtOEtSO_2NH$ | Et | $MeSO_2NH$ |
| 38 | $EtOEtOEtSO_2NH$ | Et | $PrSO_2NH$ |
| 39 | $PrSO_2NH$ | Et | $MeSO_2NH$ |
| 40 | $PrSO_2NH$ | Me | $MeSO_2NH$ |
| 41 | $MeSO_2NH$ | Et | $EtSO_2NH$ |
| 42 | $EtSO_2NH$ | Et | $EtSO_2NH$ |
| 43 | $BuSO_2NH$ | Et | $MeSO_2NH$ |
| 44 | $BuSO_2NH$ | Et | $CO_2H$ |
| 45 | $BuSO_2NH$ | Me | $MeSO_2NH$ |
| 46 | $MeSO_2NH$ | Et | $BuSO_2NH$ |

TABLE VII

Miscellaneous Dyes

Dye

47

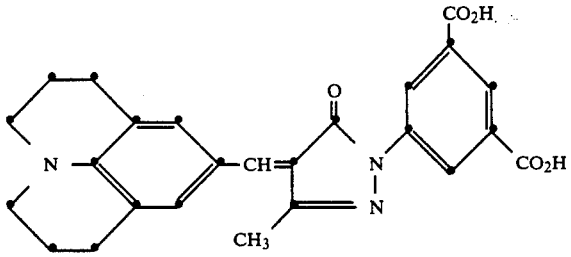

λ-max = 502 nm
ε-max = $5.47 \times 10^4$

48

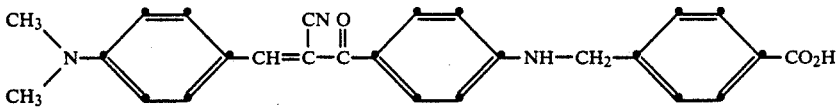

49

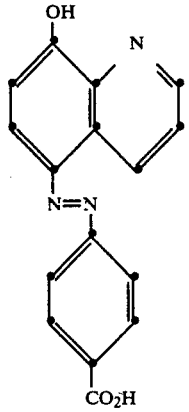

TABLE VII-continued
Miscellaneous Dyes
Dye
50
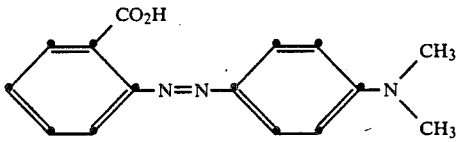
51
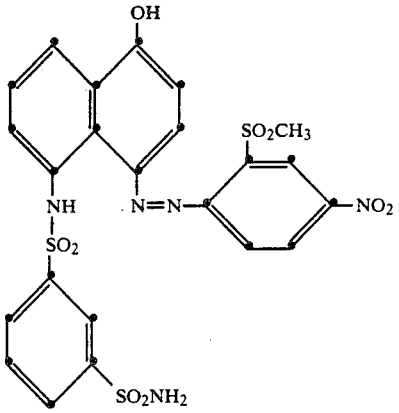
52
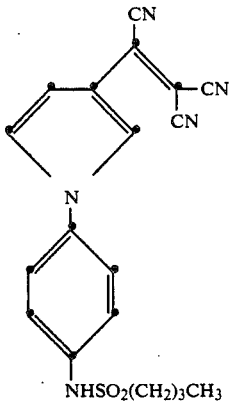
53
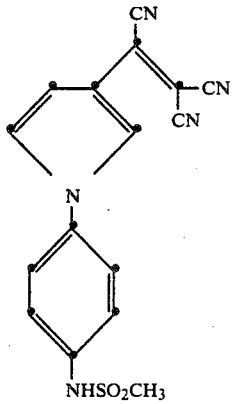

TABLE VII-continued

Miscellaneous Dyes

Dye

54

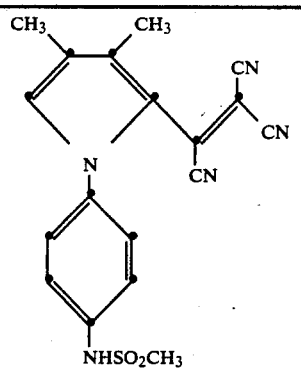

55

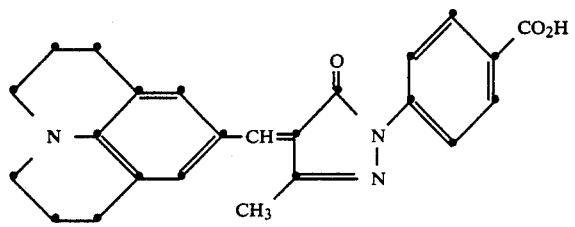

λ-max = 500 nm
ε-max = 5.82 × $10^4$

TABLE VIII

Arylidene Dyes

General Structure:

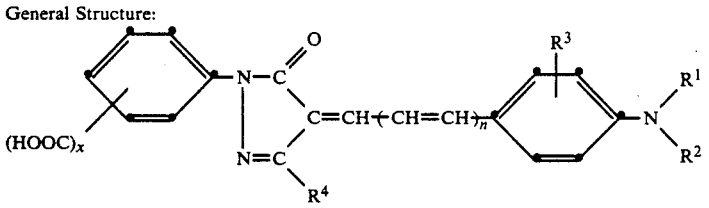

| Dye | $R^1$, $R^2$ | $R^3$ | $R^4$ | 1-Ph Substn. x Position | n | λ-max (nm) | ε-max $(10)^4$ |
|---|---|---|---|---|---|---|---|
| 56 | $CH_3$ | H | $CH_3$ | 1 4 | 0 | 466 | 3.73 |
| 57 | $C_2H_5$ | H | $CH_3$ | 1 4 | 0 | 471 | 4.75 |
| 58 | n-$C_4H_9$ | H | $CH_3$ | 1 4 | 0 | 475 | 4.50 |
| 59 | $CH_3$ | H | $COOC_2H_5$ | 1 4 | 0 | 508 | 5.20 |
| 60 | i-$C_3H_7OC(=O)CH_2$ | $CH_3$ | $CH_3$ | 1 4 | 0 | 430 | 3.34 |
| 61 | $CH_3$ | H | $CH_3$ | 2 3,5 | 0 | 457 | 3.78 |
| 62 | $C_2H_5$ | H | $CH_3$ | 2 3,5 | 0 | 475 | 4.55 |
| 63 | n-$C_4H_9$ | H | $CH_3$ | 2 3,5 | 0 | 477 | 4.92 |
| 64 | i-$C_3H_7OC(=O)CH_2$ | H | $CH_3$ | 2 3,5 | 0 | 420 | 3.62 |
| 65 | i-$C_3H_7OC(=O)CH_2$ | $CH_3$ | $CH_3$ | 2 3,5 | 0 | 434 | 3.25 |
| 66 | i-$C_3H_7OCCH_2$ | H | $CH_3$ | 1 4 | 0 | 420 | 3.94 |
| 67 | $CH_3$ | H | O‖C $CH_3$ | 1 4 | 1 | 573 | 5.56 |
| 68 | $CH_3$ | H | COOEt | 1 3,5 | 0 | 502 | 4.83 |
| 69 | $C_2H_5$ | H | COOEt | 1 4 | 0 | 512 | 6.22 |
| 70 | $CH_3$ | H | $CF_3$ | 1 4 | 0 | 507 | 4.58 |

TABLE VIII-continued
Arylidene Dyes
General Structure:
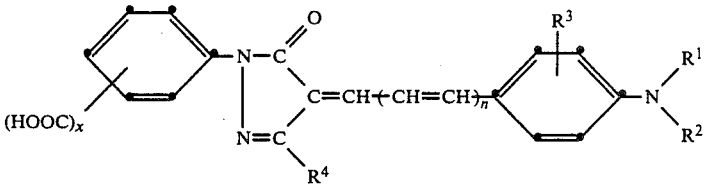
| Dye | $R^1$, $R^2$ | $R^3$ | $R^4$ | 1-Ph Substn. x Position | n | λ-max (nm) | ε-max $(10)^4$ |
|---|---|---|---|---|---|---|---|
| 71 | $CH_3$ | H | Ph | 1 4 | 0 | 477 | 4.54 |
| 72 | $CH_3$ | H | O ‖ C $CH_3$ | 1 4 | 0 | 506 | 5.36 |
TABLE IX
Oxazole and Oxazoline Pyrazolone Merocyanine Dyes
73
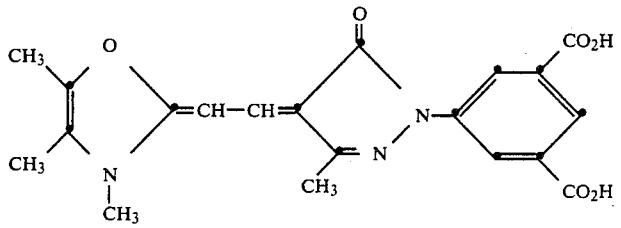
74
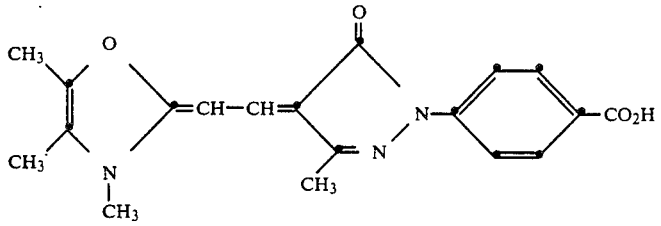
75
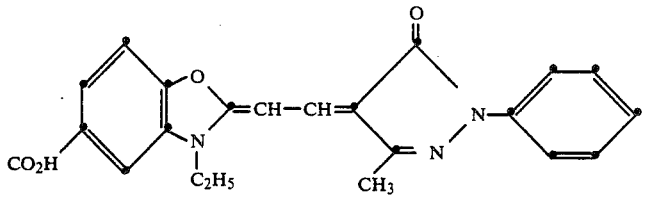
76
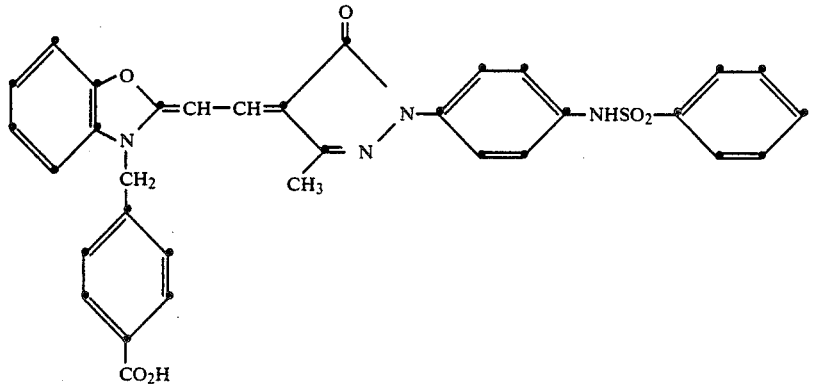

TABLE IX-continued
Oxazole and Oxazoline Pyrazolone Merocyanine Dyes
77
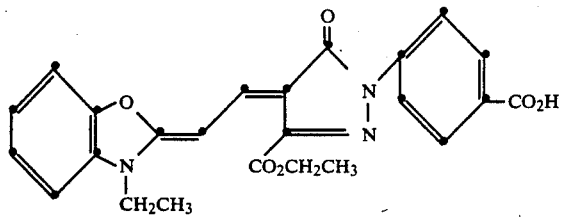
78
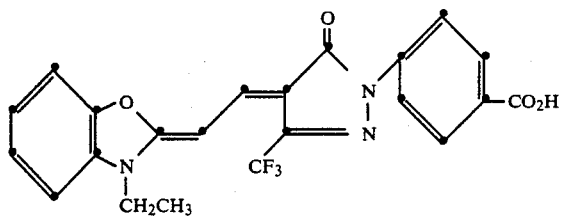
79
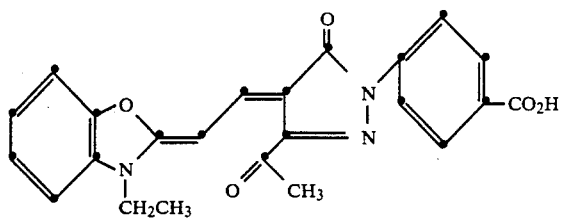
80
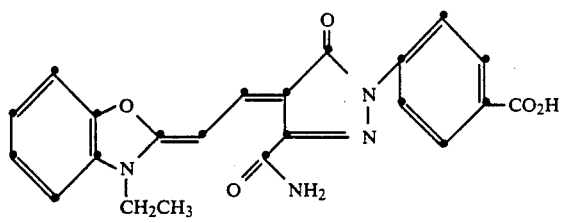
81
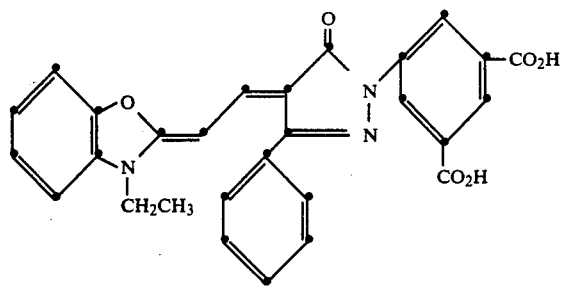
82
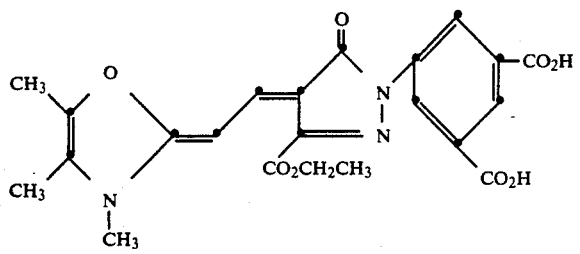

TABLE IX-continued
Oxazole and Oxazoline Pyrazolone Merocyanine Dyes
83
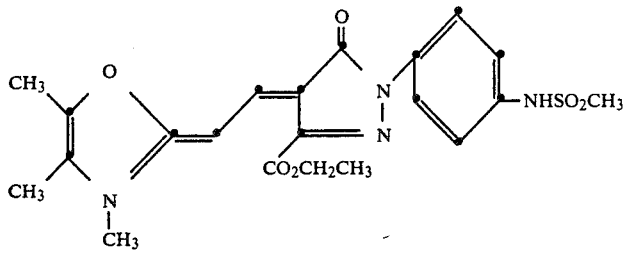
84
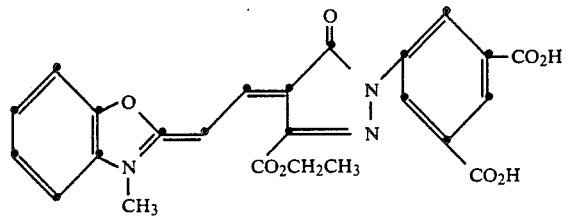
85
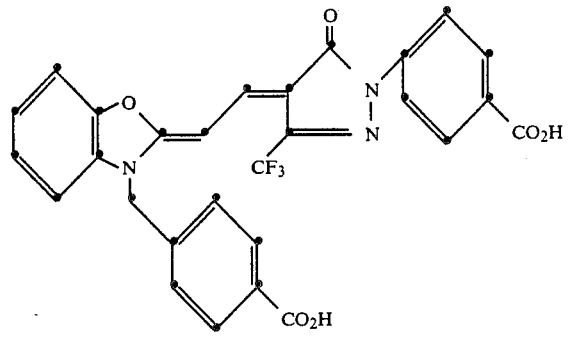
86
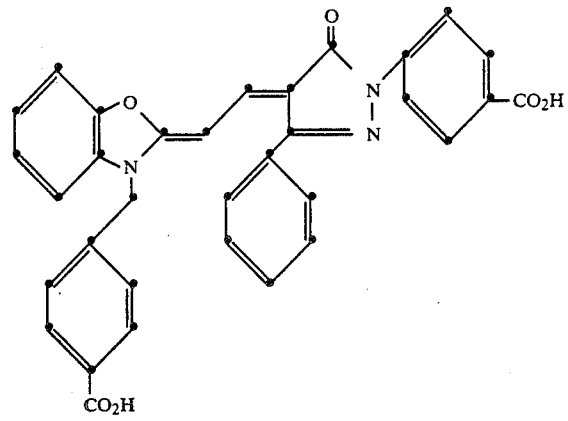
87
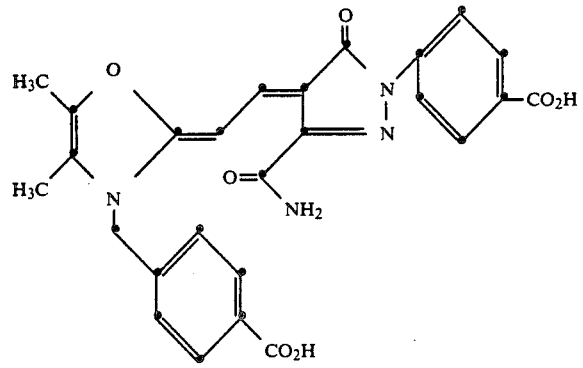

TABLE IX-continued
Oxazole and Oxazoline Pyrazolone Merocyanine Dyes
88
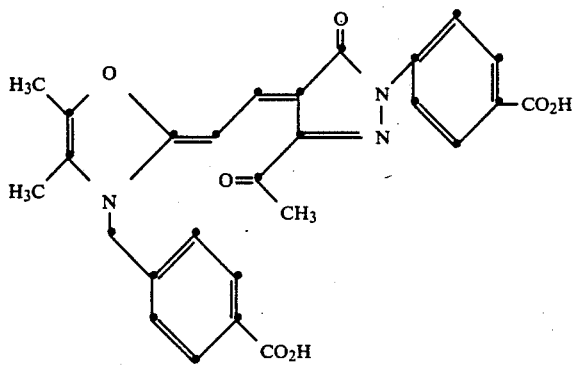
89
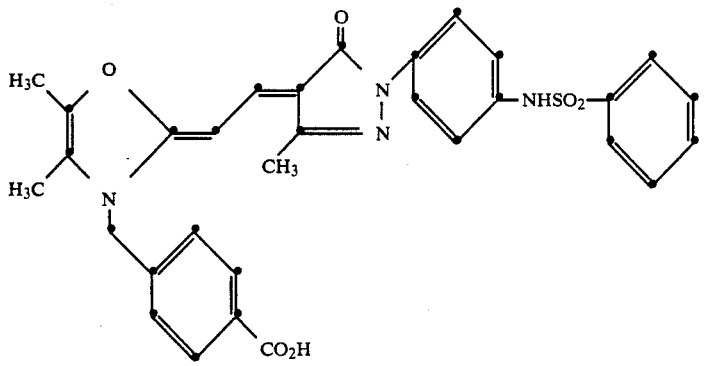
90
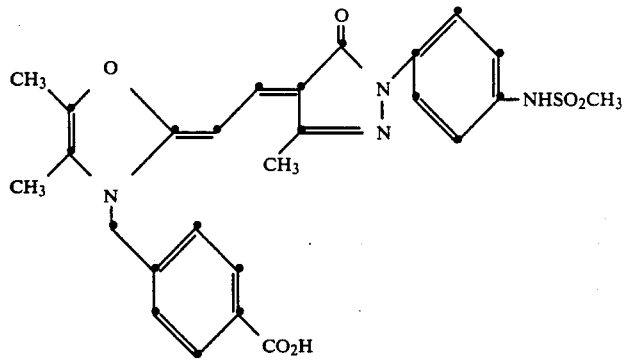
91
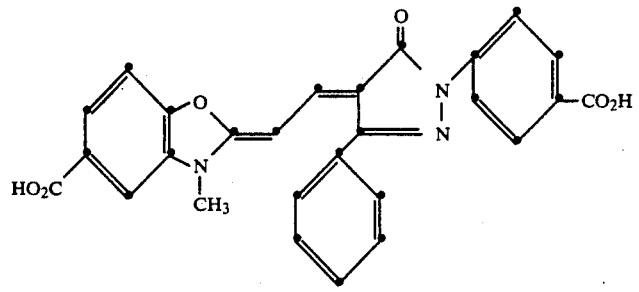

TABLE IX-continued
Oxazole and Oxazoline Pyrazolone Merocyanine Dyes
92
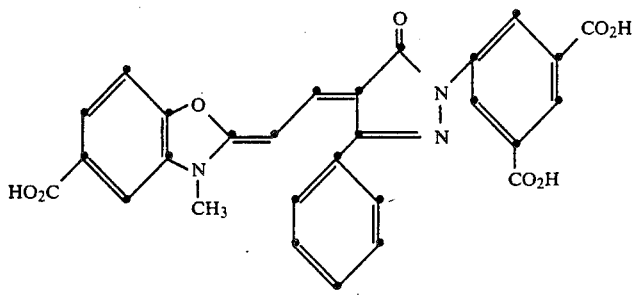
93
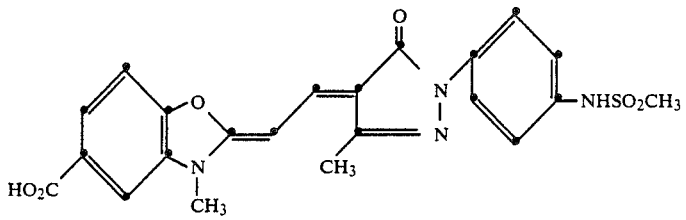
94
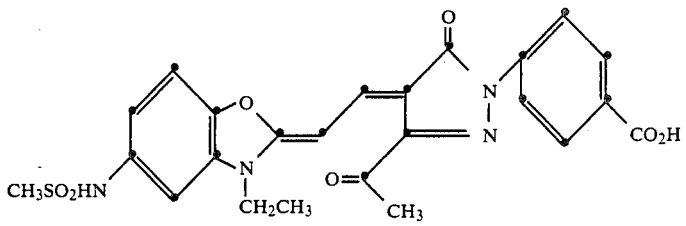
95
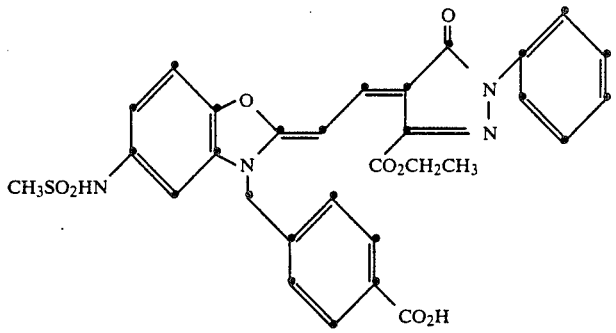
96
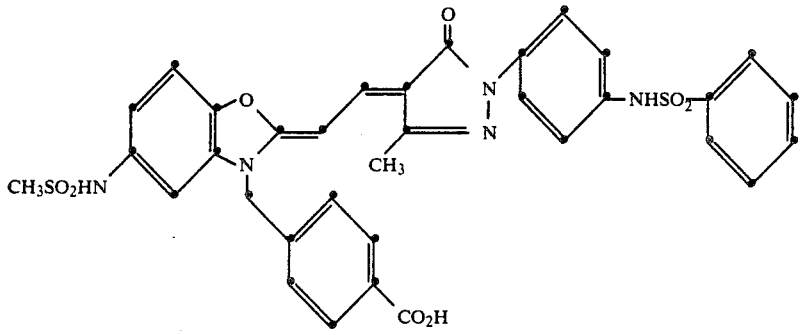

TABLE IX-continued
Oxazole and Oxazoline Pyrazolone Merocyanine Dyes
97
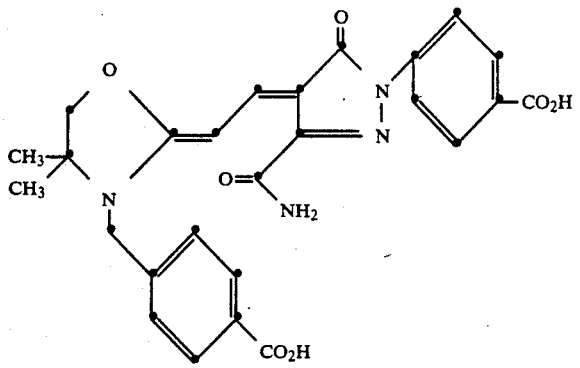
98
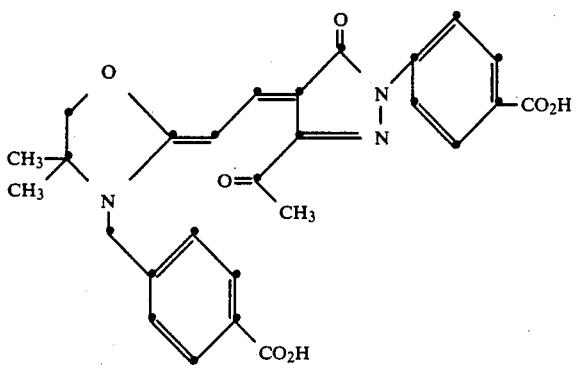
99
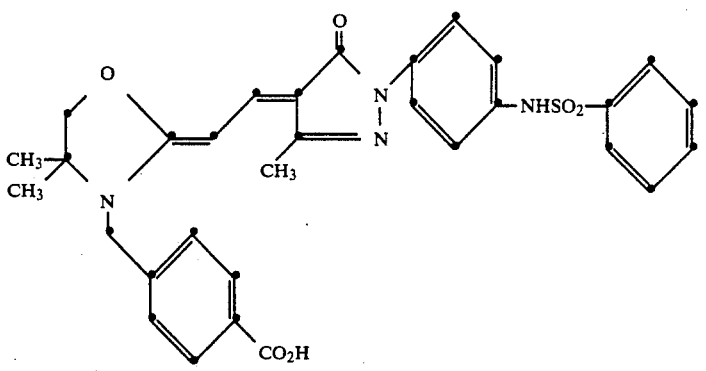
TABLE X
Oxazole and Oxazoline Benzoylacetonitrile Merocyanine Dyes
100
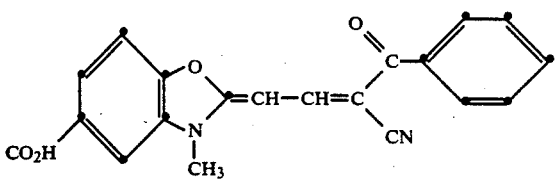
101
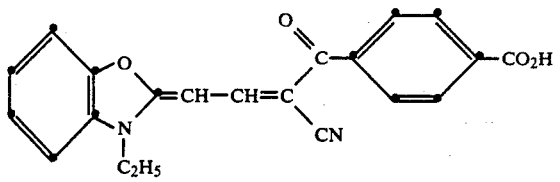

TABLE X-continued
Oxazole and Oxazoline Benzoylacetonitrile Merocyanine Dyes
102
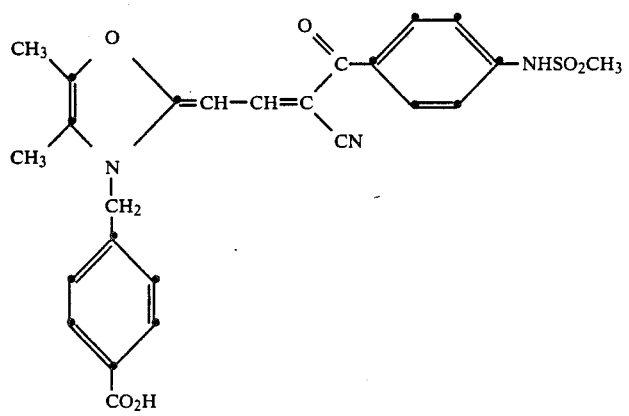
103
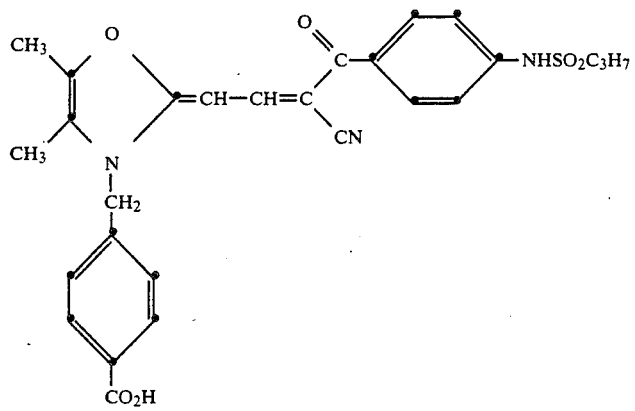
104
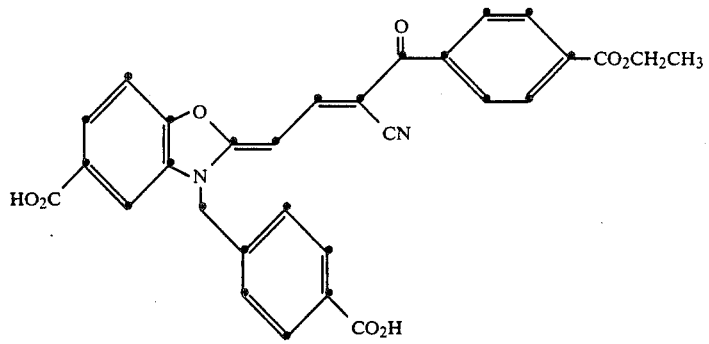
105
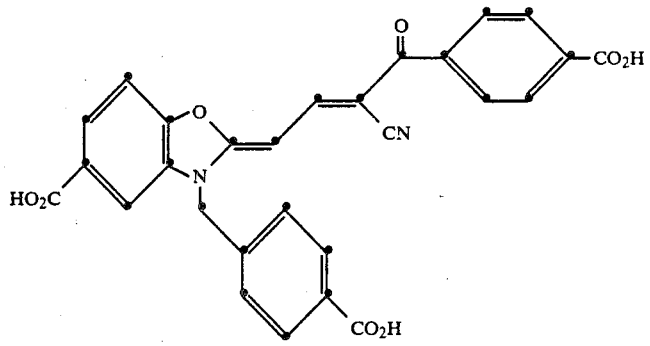

TABLE X-continued
Oxazole and Oxazoline Benzoylacetonitrile
Merocyanine Dyes
106
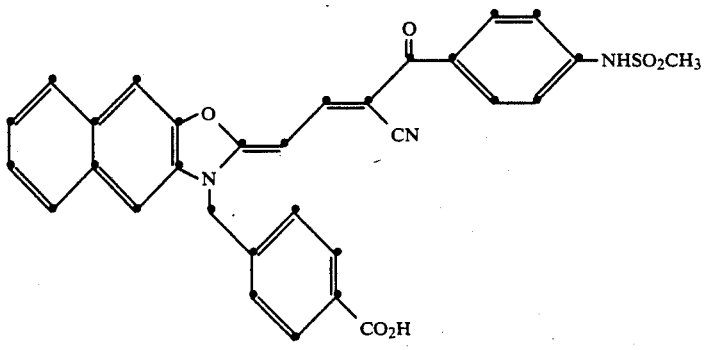
107
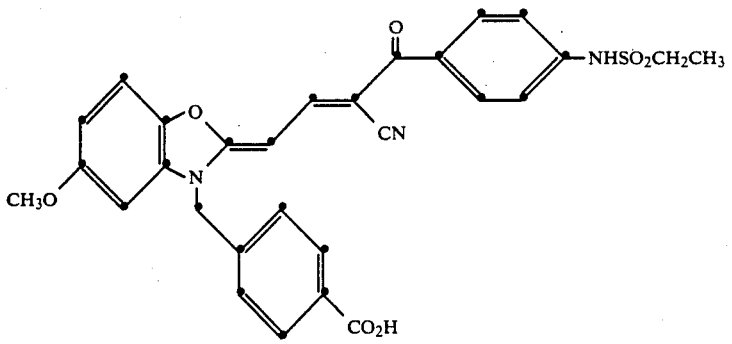
108
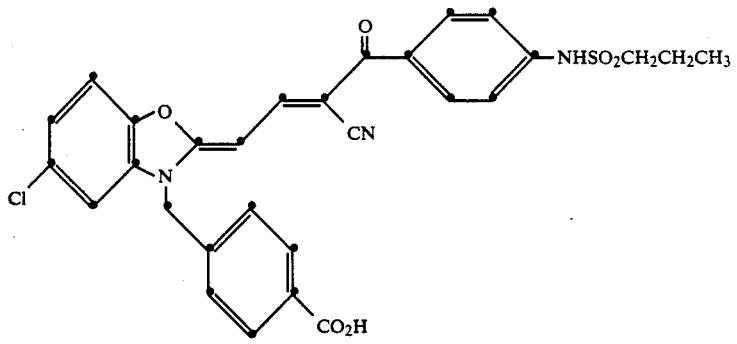
109
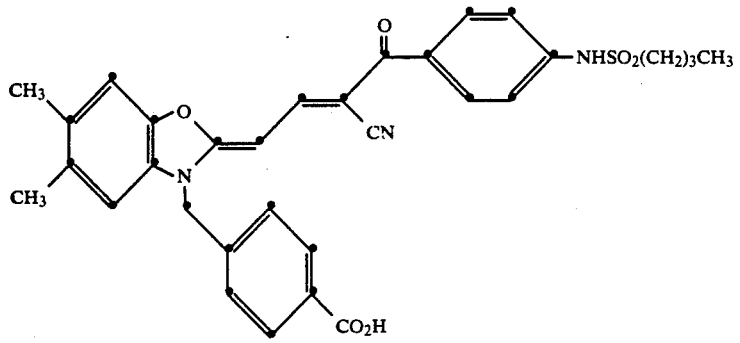

TABLE X-continued
Oxazole and Oxazoline Benzoylacetonitrile
Merocyanine Dyes
110
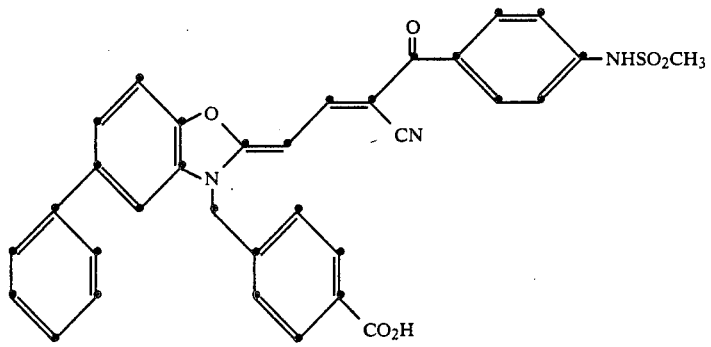
111
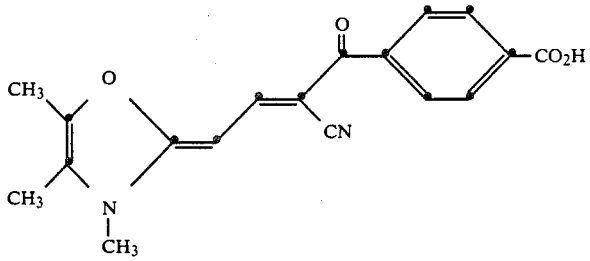
112
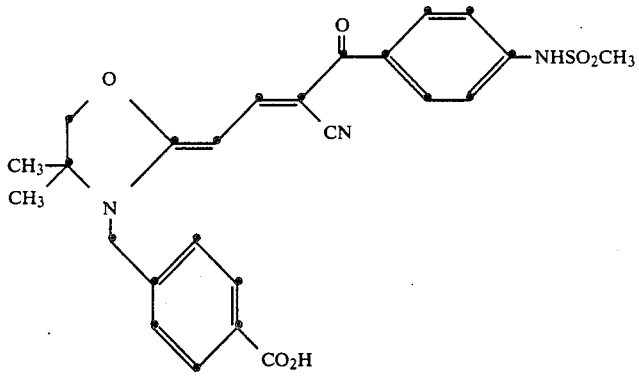
113
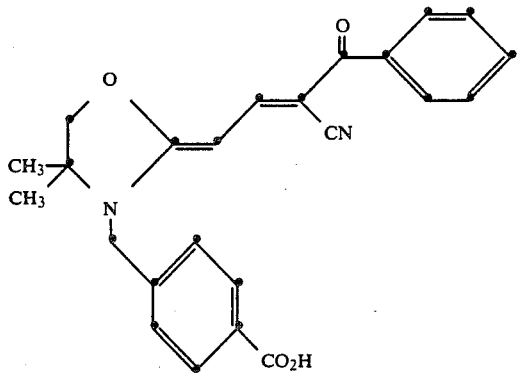

TABLE X-continued
Oxazole and Oxazoline Benzoylacetonitrile Merocyanine Dyes
114
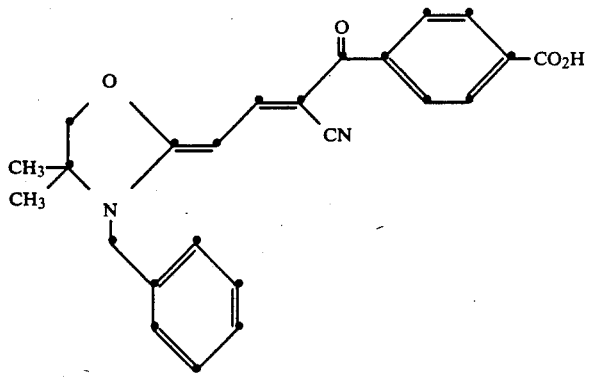
115
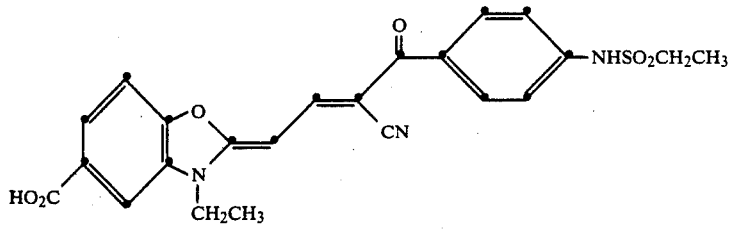
116
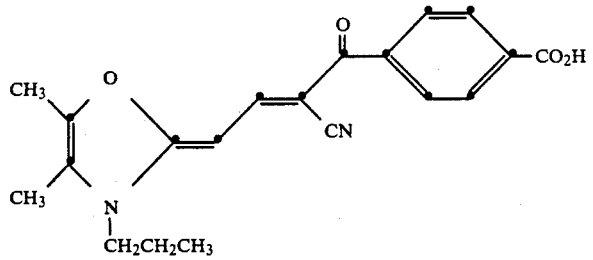
117
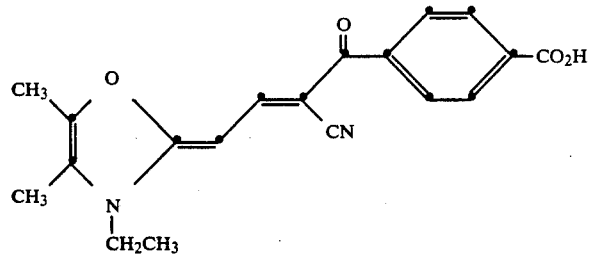
118
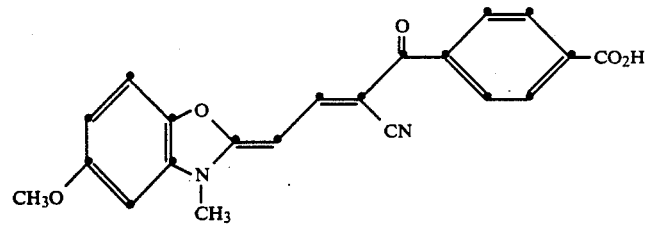
119
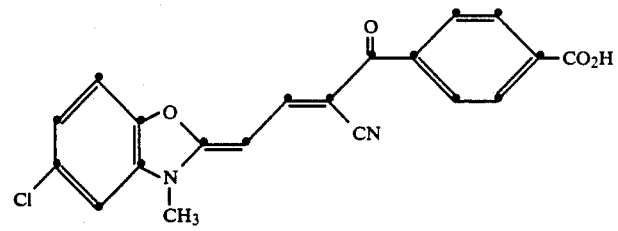

TABLE X-continued
Oxazole and Oxazoline Benzoylacetonitrile Merocyanine Dyes
120
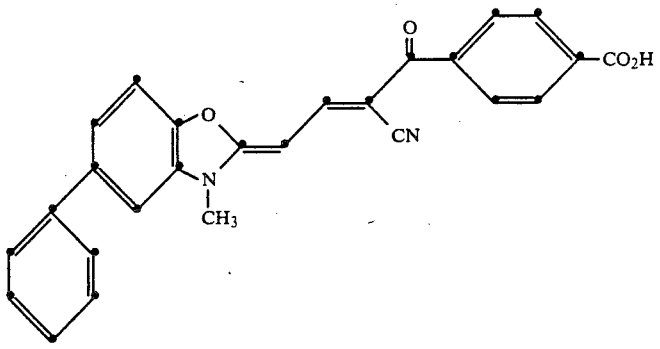
121
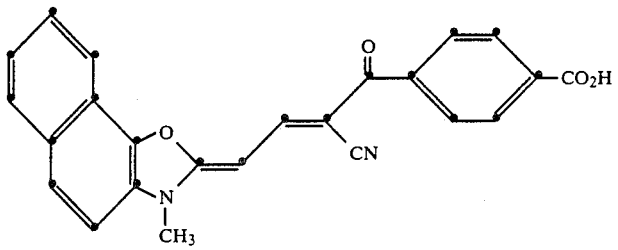
122
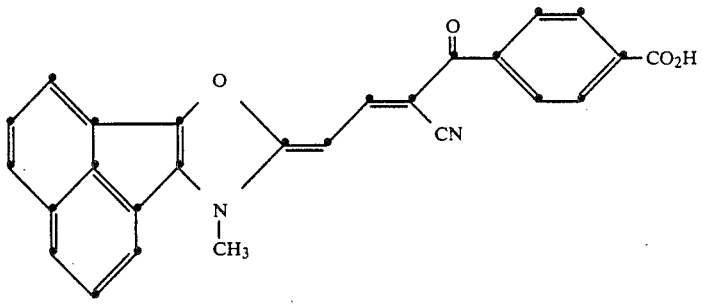
123
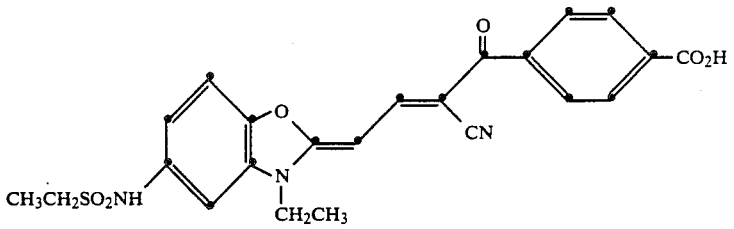
124
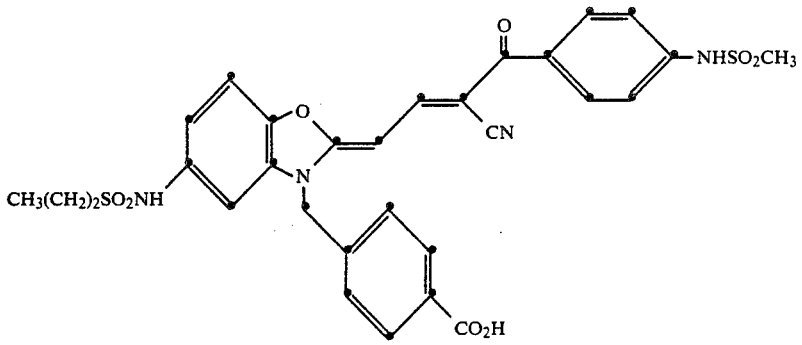

TABLE XI

Oxonol Dyes

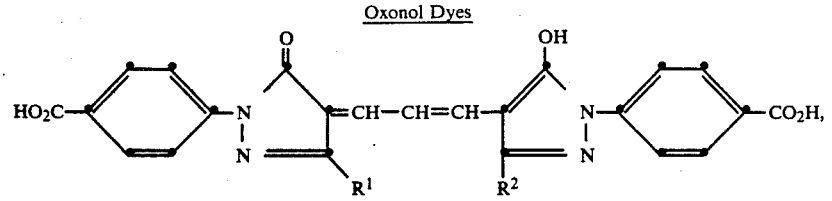

| Dye | wherein $R^1$ | $R^2$ |
|---|---|---|
| 125 | $CH_3$ | $CH_3$ |
| 126 | $C_2H_5$ | $C_2H_5$ |

The dye can be added directly to the hydrophilic colloid as a particulate solid or can be converted to a particulate solid after it is added to the hydrophilic colloid. One example of the latter technique is to dissolve a dye which is not water soluble in a solvent which is water soluble. When the dye solution is mixed with an aqueous hydrophilic colloid, followed by noodling and washing of the hydrophilic colloid (see *Research Disclosure*, Item 17643, cited above, Section II), the dye solvent is removed, leaving particulate dye dispersed within the hydrophilic colloid. Thus, any water insoluble dye which that is soluble in a water miscible organic solvent can be employed as a particulate dye in the practice of the invention, provided the dye is susceptible to bleaching under processing conditions-e.g., at alkaline pH levels. Specific examples of contemplated water miscible organic solvents are methanol, ethyl acetate, cyclohexanone, methyl ethyl ketone, 2-(2-butoxyethoxy)ethyl acetate, triethyl phosphate, methylacetate, acetone, ethanol, and dimethylformamide. Dyes preferred for use with these solvents are sulfonamide substituted arylidene dyes, specifically preferred examples of which are set forth about in Tables IIA and III.

In addition to being present in particulate form and satisfying the optical density requirements set forth above, the dyes employed in the under layer units must be substantially decolorized on processing. The term "substantially decolorized" is employed to mean that the dye in the under layer units raises the minimum density of the radiographic element when fully processed under the reference processing conditions, stated above, by no more than 0.1, preferably no more than 0.05, within the visible spectrum. As shown in the examples below the preferred particulate dyes produce no significant increase in the optical density of fully processed radiographic elements of the invention.

As indicated above, it is specifically contemplated to employ a UV absorber, preferably blended with the dye in each of crossover reducing layers 111 and 113. Any conventional UV absorber can be employed for this purpose. Illustrative useful UV absorbers are those disclosed in *Research Disclosure*, Item 18431, cited above, Section V, or *Research Disclosure*, Item 17643, cited above, Section VIII(C), both here incorporated by reference. Preferred UV absorbers are those which either exhibit minimal absorption in the visible portion of the spectrum or are decolorized on processing similarly as the crossover reducing dyes.

Overlying the under layer unit on each major surface of the support is at least one additional hydrophilic colloid layer, specifically at one halide emulsion layer unit comprised of a spectrally sensitized silver bromide or bromoiodide tabular grain emulsion layer. At least 50 percent (preferably at least 70 percent and optimally at least 90 percent) of the total grain projected area of the tabular grain emulsion is accounted for by tabular grains having a thickness less than 0.3 μm (preferably less than 0.2 μm) and an average aspect ratio of greater than 5:1 (preferably greater than 8:1 and optimally at least 12:1). Preferred tabular grain silver bromide and bromoiodide emulsions are those disclosed by Wilgus et al U.S. Pat. No. 4,434,226; Kofron et al U.S. Pat. No. 4,439,530; Abbott et al U.S. Pat. Nos. 4,425,425 and 4,425,426; Dickerson U.S. Pat. No. 4,414,304; Maskasky U.S. Pat. No. 4,425,501; and Dickerson U.S. Pat. No. 4,520,098; the disclosures of which are here incorporated by reference.

Both for purposes of achieving maximum imaging speed and minimizing crossover the tabular grain emulsions are substantially optimally spectrally sensitized. That is, sufficient spectral sensitizing dye is adsorbed to the emulsion grain surfaces to achieve at least 60 percent of the maximum speed attainable from the emulsions under the contemplated conditions of exposure. It is known that optimum spectral sensitization is achieved at about 25 to 100 percent or more of monolayer coverage of the total available surface area presented by the grains. The preferred dyes for spectral sensitization are polymethine dyes, such as cyanine, merocyanine, hemicyanine, hemioxonol, and merostyryl dyes. Specific examples of spectral sensitizing dyes and their use to sensitize tabular grain emulsions are provided by Kofron et al U.S. Pat. No. 4,439,520, here incorporated by reference.

Although not a required feature of the invention, the tabular grain emulsions are rarely put to practical use without chemical sensitization. Any convenient chemical sensitization of the tabular grain emulsions can be undertaken. The tabular grain emulsions are preferably substantially optimally (as defined above) chemically and spectrally sensitized. Useful chemical sensitizations, including noble metal (e.g., gold) and chalcogen (e.g., sulfur and/or selenium) sensitizations as well as selected site epitaxial sensitizations, are disclosed by the patents cited above relating to tabular grain emulsions, particularly Kofron et al and Maskasky.

In addition to the grains and spectral sensitizing dye the emulsion layers can include as vehicles any one or combination of various conventional hardenable hydrophilic colloids alone or in combination with vehicle extenders, such as latices and the like. The vehicles and vehicle extenders of the emulsion layer units can be identical to those of the interlayer units. The vehicles and vehicle extenders can be selected from among those disclosed by *Research Disclosure*, Item 17643, cited above, Section IX, here incorporated by reference. Specifically preferred hydrophilic colloids are gelatin and gelatin derivatives.

The coating coverages of the emulsion layers are chosen to provide on processing the desired maximum density levels. For radiography maximum density levels are generally in the range of from about 3 to 4, although specific applications can call for higher or lower density levels. Since the silver images produced on opposite sides of the support are superimposed during viewing, the optical density observed is the sum of the optical densities provided by each emulsion layer unit. Assuming equal silver coverages on opposite major surfaces of the support, each emulsion layer unit should contain a silver coverage from about 18 to 30 mg/dm$^2$, preferably 21 to 27 mg/dm$^2$.

It is conventional practice to protect the emulsion layers from damage by providing overcoat layers. The overcoat layers can be formed of the same vehicles and vehicle extenders disclosed above in connection with the emulsion layers. The overcoat layers are most commonly gelatin or a gelatin derivative.

To avoid wet pressure sensitivity the total hydrophilic colloid coverage on each major surface of the support must be at least 35 mg/dm$^2$. It is an observation of this invention that it is the total hydrophilic colloid coverage on each surface of the support and not, as has been generally believed, simply the hydrophilic colloid coverage in each silver halide emulsion layer that controls its wet pressure sensitivity. Thus, with 10 mg/dm$^2$ of hydrophilic colloid being required in the interlayer unit for coating uniformity, the emulsion layer can contain as little as 20 mg/dm$^2$ of hydrophilic colloid.

To allow rapid access processing of the radiographic element the total hydrophilic coating coverage on each major surface of the support must be less than 65 mg/dm$^2$, preferably less than 55 mg/dm$^2$, and the hydrophilic colloid layers must be substantially fully forehardened. By substantially fully forehardened it is meant that the processing solution permeable hydrophilic colloid layers are forehardened in an amount sufficient to reduce swelling of these layers to less than 300 percent, percent swelling being determined by the following reference swell determination procedure: (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b). This reference procedure for measuring forehardening is disclosed by Dickerson U.S. Pat. No. 4,414,304. Employing this reference procedure, it is preferred that the hydrophilic colloid layers be sufficiently forehardened that swelling is reduced to less than 200 percent under the stated test conditions.

Any conventional transparent radiographic element support can be employed. Transparent film supports, such as any of those disclosed in *Research Disclosure*, Item 17643, cited above, Section XIV, are all contemplated. Due to their superior dimensional stability the transparent film supports preferred are polyester supports. Poly(ethylene terephthalate) is a specifically preferred polyester film support. The support is typically tinted blue to aid in the examination of image patterns. Blue anthracene dyes are typically employed for this purpose. In addition to the film itself, the support is usually formed with a subbing layer on the major surface intended to receive the under layer units. For further details of support construction, including exemplary incorporated anthracene dyes and subbing layers, refer to *Research Disclosure*, Item 18431, cited above, Section XII.

In addition to the features of the radiographic elements of this invention set forth above, it is recognized that the radiographic elements can and in most practical applications will contain additional conventional features. Referring to *Research Disclosure*, Item 18431, cited above, the emulsion layer units can contain stabilizers, antifoggants, and antikinking agents of the type set forth in Section II, and the overcoat layers can contain any of variety of conventional addenda of the type set forth in Section IV. The outermost layers of the radiographic element can also contain matting agents of the type set out in *Research Disclosure*, Item 17643, cited above, Section XVI. Referring further to *Research Disclosure*, Item 17643, incorporation of the coating aids of Section XI, the plasticizers and lubricants of Section XII, and the antistatic layers of Section XIII, are each contemplated.

The intensifying screens can be selected from among various conventional intensifying screens, such as those disclosed in *Research Disclosure*, Item 18431, cited above, Section IX, the disclosure of which is here incorporated by reference. Intensifying screens typically consist of a support, which can be transparent, light absorbing, or reflective, depending upon the speed and sharpness required for the specific imaging application. A fluorescent layer is coated on the support containing a phosphor and a binder. Light absorbers, such as carbon or dyes, light scattering materials, such as titania, and sometimes combinations of both can be employed to tailor the speed and/or sharpness of screen emission to match the requirements of a specific imaging application.

For higher performance applications preferred phosphors include calcium tungstate ($CaWO_4$); niobium and/or rare earth activated yttrium, lutetium, and gadolinium tantalates; and rare earth activated rare earth oxychalcogenides and halides. As herein employed rare earths are elements having an atomic number of 39 or 27 through 71. The rare earth oxychalcogenide and halide phosphors are preferably chosen from among those of the Formula XI.

$$M_{(w-n)}M'_nO_wX \qquad \text{(IX)}$$

wherein:

M is at least one of the metals yttrium, lanthanum, gadolinium, or lutetium,

M′ is at least one of the rare earth metals, preferably dysprosium, erbium, europium, holmium, neodymium, praseodymium, samarium, terbium, thulium, or ytterbium, X is a middle chalcogen (S, Se, or Te) or halogen, n is 0.0002 to 0.2, and w is 1 when X is halogen or 2 when X is chalcogen.

Calcium tungstate phosphors are illustrated by Wynd et al U.S. Pat. No. 2,303,942. Niobium-activated and rare earth-activated yttrium, lutetium, and gadolinium tantalates are illustrated by Brixner U.S. Pat. No. 4,225,653. Rare earth-activated gadolinium and yttrium middle chalcogen phosphors are illustrated by Royce U.S. Pat. No. 3,418,246. Rare earth-activated lanthanum and lutetium middle chalcogen phosphors are illustrated by Yocom U.S. Pat. No. 3,418,247. Terbium-activated lanthanum, gadolinium, and lutetium oxysulfide phosphors are illustrated by Buchanan et al U.S. Pat. No. 3,725,704. Cerium-activated lanthanum oxychloride phosphors are disclosed by Swindells U.S. Pat. No. 2,729,604. Terbium-activated and optionally cerium-activated lanthanum and gadolinium oxyhalide phosphors are disclosed by Rabatin U.S. Pat. No. 3,617,743 and Ferri et al U.S. Pat. No. 3,974,389. Rare earth-activated rare earth oxyhalide phosphors are illustrated by Rabatin U.S. Pat. Nos. 3,591,516 and 3,607,770. Terbium-activated and ytterbium-activated rare earth oxyhalide phosphors are disclosed by Rabatin U.S. Pat. No. 3,666,676. Thulium-activated lanthanum oxychloride or oxybromide phosphors are illustrated by Rabatin U.S. Pat. No. 3,795,814. A $(Y,Gd)_2O_2S:Tb$ phosphor wherein the ratio of yttrium to gadolinium is between 93:7 and 97:3 is illustrated by Yale U.S. Pat. No. 4,405,691. Non-rare earth coactivators can be employed, as illustrated by bismuth and ytterbium-activated lanthanum oxychloride phosphors disclosed in Luckey et al U.S. Pat. No. 4,311,487. The mixing of phosphors as well as the coating of phosphors in separate layers of the same screen are specifically recognized. A phosphor mixture of calcium tungstate and yttrium tantalate is illustrated by Patten U.S. Pat. No. 4,387,141. However, in general neither mixtures nor multiple phosphor layers within a single screen are preferred or required.

The optimum assembly performance is realized when the optimum level of front screen X radiation absorption is achieved with the thinnest possible front screen phosphor layer. This requires use of phosphors with the highest absorption efficiencies known. Thus, the optimum phosphors for construction of the front screen are calcium tungstate and niobium-activated or thulium-activated yttrium tantalate for ultraviolet and blue light emissions and terbium-activated gadolinium or lutetium oxysulfide for green light emissions.

The phosphors can be used in any conventional particle size range and distribution. It is generally appreciated that sharper images are realized with smaller mean particle sizes, but light emission efficiency declines with decreasing particle size. Thus, the optimum mean particle size for a given application is a reflection of the balance between imaging speed and image sharpness desired. Conventional phosphor particle size ranges and distributions are illustrated in the phosphor teachings cited above.

The same order of preference applies for phosphors used in the back screen as indicated above for the front screen. However, the lower permissible MTF's and greater thicknesses of the back screen permit phosphors of somewhat lower efficiencies of absorption and/or emission to be employed while still satisfying acceptable imaging characteristics.

While it is recognized that the phosphor layers need not contain a separate binder, in most applications the phosphor layers contain sufficient binder to give structural coherence to the phosphor layer. In general the binders useful in the practice of the invention are those conventionally employed in the art. Binders are generally chosen from a wide variety of known organic polymers which are transparent to X radiation and emitted light. Binders commonly employed in the art include sodium o-sulfobenzaldehye acetal of poly(vinyl alcohol); chlorosulfonated poly(ethylene); a mixture of macromolecular bisphenol poly(carbonates) and copolymers comprising bisphenol carbonates and poly(alkylene oxides); aqueous ethanol soluble nylons; poly(alkyl acrylates and methacrylates) and copolymers of poly(alkyl acrylates and methacrylates with acrylic and methacrylic acid); poly(vinyl butyral); and poly(urethane) elastomers. These and other useful binders are disclosed in U.S. Pat. Nos. 2,502,529; 2,887,379; 3,617,285; 3,300,310; 3,300,311; and 3,743,833; and in *Research Disclosure*, Vol. 154, February 1977, Item 15444, and Vol. 182, June 1979. *Research Disclosure* is published by Kenneth Mason Publications, Ltd., Emsworth, Hampshire P010 7DD, England. Particularly preferred binders are poly(urethanes), such as those commercially available under the trademark Estane from Goodrich Chemical Co., the trademark Permuthane from the Permuthane Division of Beatrice Foods Co., and the trademark Cargill from Cargill, Inc.

Any conventional ratio of phosphor to binder can be employed. Generally thinner phosphor layers and sharper images are realized when a high weight ratio of phosphor to binder is employed. Preferred phosphor to binder ratios are in the range of from about 10:1 to 25:1 for screen constructions intended to equal commercial screen exposure repetitions without loss of structural integrity. For limited or single exposure applications it is, of course, appreciated that any minimal amount of binder consistent with structural integrity is satisfactory.

In those instances in which it is desired to reduce the effective thickness of a phosphor layer below its actual thickness (thereby enhancing sharpness) the phosphor layer is modified to impart a small, but significant degree of light absorption. If the binder is chosen to exhibit the desired degree of light absorption, then no other ingredient of the phosphor layer is required to perform the light attenuation function. For example, a slightly yellow transparent polymer will absorb a significant fraction of phosphor emitted blue light. Ultraviolet absorption can be similarly achieved. It is specifically noted that the less structurally complex chromophores for ultraviolet absorption particularly lend themselves to incorporation in polymers.

In most instances a separate absorber is incorporated in the phosphor layer to reduce its effective thickness. The absorber can be a dye or pigment capable of absorbing light within the spectrum emitted by the phosphor. Yellow dye or pigment selectively absorbs blue light emissions and is particularly useful with a blue emitting phosphor. On the other hand, a green emitting phosphor is better used in combination with magenta dyes or pigments. Ultraviolet emitting phosphors can be used with known ultraviolet absorbers. Black dyes and pigments are, of course, generally useful with phosphors, because of their broad absorption spectra. Carbon black is a preferred light absorber for incorporation in the phosphor layers. Luckey and Cleare U.S. Pat. No. 4,259,588, here incorporated by reference, teaches that increased sharpness (primarily attributable to reduced crossover, discussed below) can be achieved by incorporating a yellow dye in a terbium-activated gadolinium oxysulfide phosphor layer.

The patents cited above for phosphor teachings also disclose typical screen constructions. The screen supports are most commonly film supports of high dimensional integrity, such as poly(ethylene terephthalate) film supports. For best image definition, when the front screen support and subbing and anticurl layers are transparent, the phosphor layer contains an absorber or a black surface is positioned adjacent the anticurl layer during exposure. For example, a black poly(vinyl chloride) or paper sheet can be positioned adjacent the anticurl layer. Typically the adjacent interior surface of the cassette in which the assembly is mounted is a black polyurethane (or similar polymeric) foam layer, which can be relied upon for light absorption contributing to image sharpness. When the screen supports are not themselves black, best sharpness levels are realized when a black film or paper is interposed between the cassette and each screen of the image recording assembly. Independently of cassette construction the front screen support and/or its subbing and anticurl layers can be black or suitably colored to absorb emitted light, thereby minimizing light reflection and image sharpness degradation. The back screen support as well as its subbing and anticurl layers can be of the same form as described for the front screen. If desired to increase speed, either or both of the front and back screen supports and/or their subbing and anticurl layers can be reflective of emitted light. For example, a blue or white back screen support can be chosen to reflect light emitted by calcium tungstate or rare earth-activated yttrium tantalate or a green or white support can be chosen to reflect light emitted from a rare earth-activated lutetium or gadolinium oxysulfide phosphor. Titania is preferably coated on or incorporated in the front and back screen supports to maximize reflection of green light. Metal layers, such as aluminum, can be used to enhance reflection. Paper supports, though less common for intensifying screens than film supports, are known and can be used for specific applications. Dyes and pigments are commonly loaded into supports to enhance absorption or reflection of light. Air can be trapped in supports to reflect ultraviolet light. Intensifying screen supports and the subbing layers used to improve coating adhesion can be chosen from among those employed for silver halide photographic and radiographic elements, as illustrated by *Research Disclosure*, Item 17643, cited above, Section XVII, and *Research Disclosure*, Item 18431, cited above, Section I, the disclosures of which are here incorporated by reference.

An overcoat, though not required, is commonly located over the phosphor layer for humidity and wear protection. The overcoat can be chosen using the criteria described above for the binder. The overcoat can be chosen from among the same polymers used to form either the screen binder or the support, with the requirements of toughness and scratch resistance usually favoring polymers conventionally employed for film supports. For example, cellulose acetate is a preferred overcoat used with the preferred poly(urethane) binders. Overcoat polymers are often used also to seal the edges of the phosphor layer.

While anticurl layers are not required for the screens, they are generally preferred for inclusion. The function of the anticurl layer is to balance the forces exerted by the layers coated on the opposite major surface of the screen support which, if left unchecked, cause the screen to assume a non-planar configuration-e.g., to curl or roll up on itself. Materials forming the anticurl layers can be chosen from among those identified above for use as binders and overcoats. Generally an anticurl layer is formed for the same polymer as the overcoat on the opposite side of the support. For example, cellulose acetate is preferred for both overcoat and anticurl layers.

To prevent blocking, particularly adhesion of the radiographic element and intensifying screen, the overcoats of the phosphor layers can include a matting agent, although matting agents are more commonly included in radiographic elements than in screens. Useful matting agents can be chosen from among those cited by *Research Disclosure*, Item 17643, cited above, Section XVI. A variety of other optional materials can be included in the surface coatings of the intensifying screens, such as materials to reduce static electrical charge accumulation, plasticizers, lubricants, and the like, but such materials are more commonly included in the radiographic elements which come into contact with the intensifying screens.

In their preferred form the assemblies of this invention consist of two intensifying screens and a separate low crossover radiographic element positioned between the intensifying screens. It is, however, recognized that the three elements can, if desired, be integrated into one or two elements merely by integrating one or both of the intensifying screens with the radiographic element. For example, the assembly can take the form of a double coated radiographic element having intensifying screens optically coupled on opposite sides that are peeled away for processing after imagewise exposure. Other arrangements are possible, but not preferred, in which one or more of the intensifying screens take the form of a fluorescent layer positioned between the support and the emulsion layer unit it is intended to expose.

EXAMPLES

The invention can be better appreciated by reference to the following specific examples:

SCREENS

The following intensifying screens were employed:

SCREEN V

This screen has a composition and structure corresponding to that of a commercial, medium to high resolution screen. It consists of a terbium activated gadolinium oxysulfide phosphor having a median particle size of 5 to 6 μm coated on a blue dyed polyester support in a Permuthane TM polyurethane binder at a total phosphor coverage of 3.1 g/dm$^2$ at a phosphor to binder ratio of 19:1.

SCREEN W

This screen has a composition and structure corresponding to that of a commercial, high speed screen. It consists of a terbium activated gadolinium oxysulfide phosphor having a median particle size of 8 to 9 μm coated on a white pigmented polyester support in a Permuthane TM polyurethane binder at a total phosphor coverage of 13.3 g/dm$^2$ at a phosphor to binder ratio of 19:1.

SCREEN X

This screen has a composition and structure corresponding to that of a commercial, general purpose screen. It consists of a terbium activated gadolinium oxysulfide phosphor having a median particle size of 7 μm coated on a white pigmented polyester support in a Permuthane TM polyurethane binder at a total phosphor coverage of 7.0 g/dm$^2$ at a phosphor to binder ratio of 15:1.

SCREEN Y

This screen has a composition and structure corresponding to that of a commercial, medium resolution screen. It consists of a terbium activated gadolinium oxysulfide phosphor having a median particle size of 7 μm coated on a white pigmented polyester support in a Permuthane TM polyurethane binder at a total phosphor coverage of 5.9 g/dm$^2$ at a phosphor to binder ratio of 15:1 and containing 0.017535% by weight of a 100:1 weight ratio of a yellow dye and carbon.

SCREEN Z

This screen has a composition and structure corresponding to that of a commercial, high resolution screen. It consists of a terbium activated gadolinium oxysulfide phosphor having a median particle size of 5 μm coated on a blue tinted clear polyester support in a Permuthane TM polyurethane binder at a total phosphor coverage of 3.4 g/dm$^2$ at a phosphor to binder ratio of 21:1 and containing 0.0015% carbon.

SCREEN MODULATION TRANSFER FACTORS

Screen MTF's of the screens were measured following the procedure of Doi et al, "MTF's and Wiener Spectra of Radiographic Screen-Film Systems", cited above. The method was modified as described in Luckey et al U.S. Pat. No. 4,710,637, also cited above. However, since Luckey et al was measuring MTF's at low energy levels typical of mammography, the following changes were made to obtain MTF's corresponding to more commonly employed energy levels: A 3-phase, 12-pulse generator, with a tungsten-target X-ray tube, was employed at 90 kVp, with 3 mm aluminum filtration. The inherent filtration of the X-ray tube itself was approximately 1 mm aluminum equivalent, bringing to total X-ray beam filtration up to approximately 4 mm aluminum equivalent.

TABLE XII

Modulation Transfer Factors of Screens

| Screen | % Modulation Transfer Factor at Various Cycles/mm | | | | | | | | | | |
|---|---|---|---|---|---|---|---|---|---|---|---|
| | 0 | 1.0 | 2.0 | 3.0 | 4.0 | 5.0 | 6.0 | 7.0 | 8.0 | 9.0 | 10.0 |
| V | 100 | 87.7 | 68.5 | 52.8 | 40.3 | 30.6 | 23.5 | 18.4 | 14.8 | 12.0 | 9.8 |
| W | 100 | 47.1 | 20.8 | 11.0 | 6.8 | 4.5 | 3.1 | 2.4 | 1.9 | 1.5 | 1.3 |
| X | 100 | 63.6 | 33.0 | 18.9 | 11.4 | 7.8 | 5.6 | 4.2 | 3.2 | 2.5 | 2.0 |
| Y | 100 | 70.4 | 41.2 | 24.9 | 16.2 | 11.3 | 8.2 | 6.2 | 4.8 | 3.8 | 3.1 |
| Z | 100 | 90.7 | 73.4 | 58.0 | 45.9 | 36.5 | 29.1 | 23.5 | 19.2 | 16.0 | 13.5 |

Figure 2:
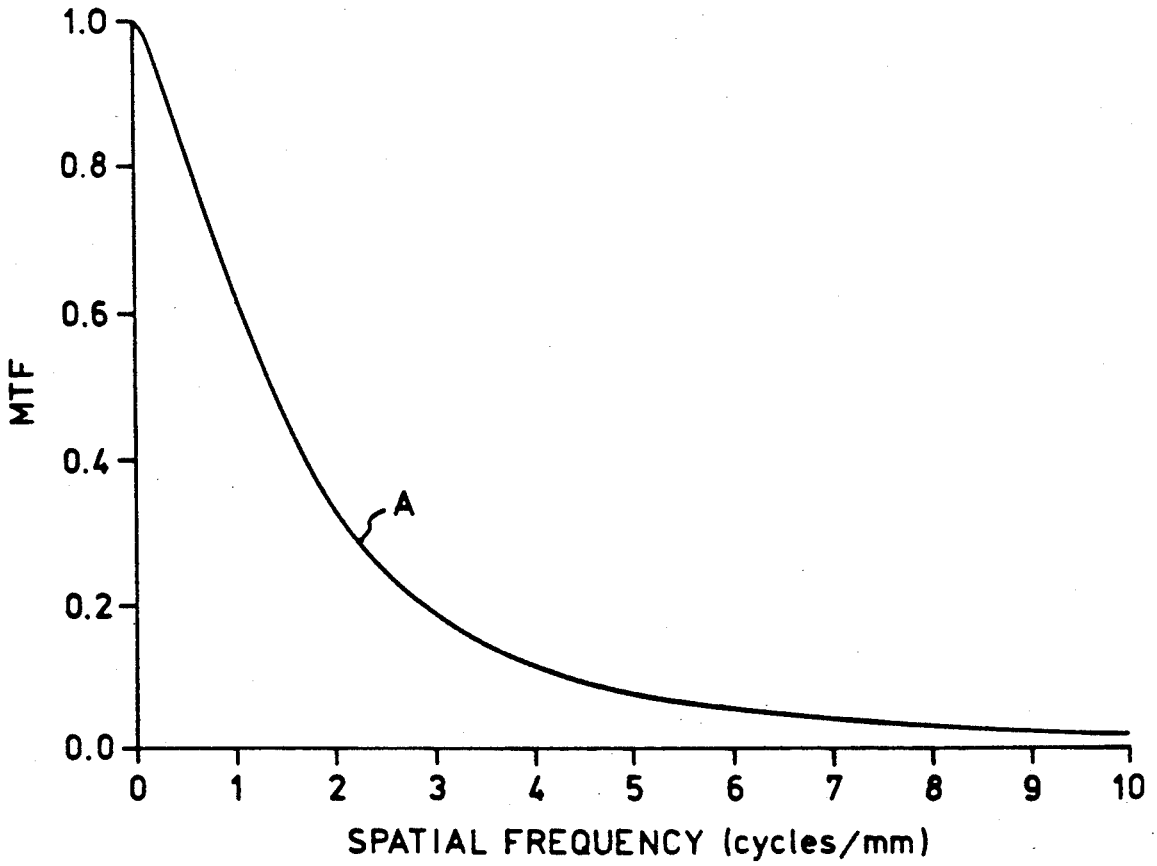
FIG. 2 is a plot of modulation transfer factors (MTF) versus spatial frequency in cycles per millimeter, providing a boundary for minimum acceptable MTF levels of the front intensifying screen of the assembly of the invention.

Curve A in FIG. 2 corresponding to the MTF profile of Screen X.

SCREEN EMISSIONS

The relative emissions of electromagnetic radiation longer than 370 nm in wavelength of the intensifying screens were determined as follows:

Screen V=150
Screen W=625
Screen X=349
Screen Y=230
Screen Z=100

The screens exhibited no significant emissions at wavelengths between 300 and 370 nm.

The X-radiation response of each screen was obtained using a tungsten target X-ray source in an XRD 6 TM generator. The X-ray tube was operated at 70 kVp and 30 mA, and the X-radiation from the tube was filtered through 0.5 mm Cu and 1 mm Al filters before reaching the screen.

The emitted light was detected by a Princeton Applied Research model 1422/01 TM intensified diode array detector coupled to an Instruments SA model HR-320 TM grating spectrograph. This instrument was calibrated to within ±0.5 nm with a resolution of better than 2 nm (full width at half maximum). The intensity calibration was performed using two traceable National Bureau of Standards sources, which yielded an arbitrary intensity scale proportional to Watts/nm/cm$^2$. The total integrated emission intensity from 250 to 700 nm was calculated on a Princeton Applied Research model 1460 OMA III TM optical multichannel analyzer by adding all data points within this region and multiplying by the bandwidth of the region.

Actual emission levels were converted to relative emission levels by dividing the emission of each screen by the emission of Screen Z and multiplying by 100.

RADIOGRAPHIC ELEMENTS

ELEMENT A

EXAMPLE

Radiographic element A was a double coated radiographic element exhibiting near zero crossover.

Radiographic element A was constructed of a blue-tinted polyester support. On each side of the support a crossover reducing layer consisting of gelatin (1.6 g/m$^2$) containing 320 mg/m$^2$ of a 1:1 weight ratio mixture of Dyes 56 and 59.

The same emulsion was identically coated over the crossover reducing layers on opposite sides of the support. The emulsion was a green-sensitized high aspect ratio tabular grain silver bromide emulsion, where the term "high aspect ratio" is employed as defined by Abbott et al U.S. Pat. No. 4,425,425 to require that at least 50 percent of the total grain projected area be accounted for by tabular grains having a thickness of less than 0.3 μm and having an average aspect ratio of greater than 8:1. The emulsion exhibited an average grain diameter of 1.7 μm and an average grain thickness of 0.13 μm. The emulsion was spectrally sensitized with 400 mg/Ag mol of anhydro-5,5-dichloro-9-ethyl-3,3'-bis(3-sulfopropyl)oxacarbocyanine hydroxide, followed by 300 mg/Ag mol of potassium iodide. The emulsion layers were each coated with a silver coverage of 2.48 g/m$^2$ and a gelatin coverage of 2.85 g/m$^2$. Protective gelatin layers (0.89 g/m$^2$) were coated over the emulsion layers. Each of the gelatin containing layers were hardened with bis(vinylsulfonylmethyl) ether at 1% of the total gelatin.

When Element A was tested for crossover as described by Abbott et al U.S. Pat. No. 4,425,425, it exhibited a crossover of 2%.

ELEMENT B

Control

Radiographic element B was a conventional double coated radiographic element exhibiting higher crossover levels.

The same emulsion was identically coated on opposite sides of the support. The emulsion was a green-sensitized high aspect ratio tabular grain silver bromide emulsion. The emulsion exhibited an average grain diameter of 2.1 μm and an average grain thickness of 0.10 μm. The emulsion was spectrally sensitized with 800 mg/Ag mol of anhydro-5,5-dichloro-9-ethyl-3,3'-bis(3-sulfopropyl)-oxacarbocyanine hydroxide, followed by 400 mg/Ag mol of potassium iodide. The emulsion layers were each coated with a silver coverage of 2.10 g/m$^2$ and a gelatin coverage of 2.85 g/m$^2$. Protective gelatin layers (0.89 g/m$^2$) were coated over the emulsion layers. Each of the gelatin containing layers were hardened with bis(vinylsulfonylmethyl) ether at 1% of the total gelatin.

When Element B was tested for crossover as described by Abbott et al U.S. Pat. No. 4,425,425, it exhibited a crossover of 20%.

ELEMENT C

Control

Radiographic element C was a conventional double coated radiographic element exhibiting extended exposure latitude.

Radiographic element C was constructed of a blue-tinted polyester support. Identical emulsion layers were coated on opposite sides of the support. The emulsion employed was a green-sensitized polydispersed silver bromide emulsion. The emulsion was a blend of two high aspect ratio tabular grain silver bromide emulsions having mean grain diameters of 2.1 and 1.2 μm and each having a mean grain thickness of about 0.1 μm. The emulsion was spectrally sensitized with 800 mg/Ag mol of anhydro-5,5-dichloro-9-ethyl-3,3'-bis(3-sulfopropyl-)oxacarbocyanine hydroxide, followed by 400 mg/Ag mol of potassium iodide. The emulsion layers were each coated with a silver coverage of 1.98 g/m$^2$. Protective gelatin layers (0.89 g/m$^2$) were coated over the emulsion layers. Each of the gelatin containing layers were hardened with bis(vinylsulfonylmethyl) ether at 1% of the total gelatin.

When Element C was tested for crossover as described by Abbott et al U.S. Pat. No. 4,425,425, it exhibited a crossover of 22%.

ELEMENT D

Example

Radiographic element D was a double coated radiographic element exhibiting near zero crossover.

Radiographic element D was constructed of a low crossover support composite (LXO) identical to that of element A, described above.

Fast low contrast (FLC) and slow high contrast (SHC) emulsion layers were coated on opposite sides of the support over the crossover reducing layers. Both emulsions were green-sensitized high aspect ratio tabular grain silver bromide emulsions sensitized and coated similarly as the emulsion layers of element A.

When coated symmetrically, with Emulsion FLC coated on both sides of the support and Emulsion SHC omitted, using a Screen X pair, Emulsion FLC exhibited a relative log speed of 113 and an average contrast of 1.98. Similarly, Emulsion SHC when coated symmetrically with Emulsion FLC omitted exhibited a relative log speed of 69 and an average contrast of 2.61. The emulsions thus differed in average contrast by 0.63 while differing in speed by 44 relative log speed units (or 0.44 log E).

When Element D was tested for crossover as described by Abbott et al U.S. Pat. No. 4,425,425, it exhibited a crossover of 2%.

ASSEMBLIES

The following assemblies were created using combinations of Screens V, W, X, Y, and Z and Elements A, B, C, and D:

TABLE XII

| Assembly | Front Screen | Film | Back Screen |
|---|---|---|---|
| Ex. Z/A/X | Z | A | X |
| Cont. Z/A/Z | Z | A | Z |
| Cont. Y/A/Y | Y | A | Y |
| Cont. X/A/X | X | A | X |
| Ex. Z/A/W | Z | A | W |
| Ex. V/A/W | V | A | W |
| Cont. Z/B/X | Z | B | X |
| Cont. Z/B/Z | Z | B | Z |
| Cont. Y/C/Y | Y | C | Y |
| Cont. Z/C/X | Z | C | X |
| Ex. Z/D/X | Z | (SHC)D(FLC) | X |
| Ex. Z/D/Z | Z | (SHC)D(FLC) | Z |

Only the example assemblies satisfied both the requirements of low crossover and a photicity of the back screen and back emulsion layer unit in combination at least twice that of the front screen and the front emulsion layer unit in combination. In the control assemblies one or both of these features were absent.

In the assembly Z/D/X and Z/D/Z the Element D was oriented with the slower, higher contrast emulsion layer unit adjacent the front screen and the faster, lower contrast emulsion layer unit adjacent the back screen.

RADIOGRAPHIC EXPOSURES

The above assemblies were in each instance exposed as follows:

The assemblies were exposed to 70 KVp X-radiation, varying either current (mA) or time, using a 3-phase Picker Medical (Model VTX-650) TM X-ray unit containing filtration up to 3 mm of aluminum. Sensitometric gradations in exposure were achieved by using a 21-increment (0.1 log E) aluminum step wedge of varying thickness.

PROCESSING

The films were processed at 35° C. in a commercially available Kodak RP X-Omat (Model 6B) TM rapid access processor in 90 seconds as follows:

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to 4.5. | |

SENSITOMETRY

Optical densities are expressed in terms of diffuse density as measured by an X-rite Model 310 TM densitometer, which was calibrated to ANSI standard PH 2.19 and was traceable to a National Bureau of Standards calibration step tablet. The characteristic curve (density vs. log E) was plotted for each radiographic element processed. Speed, reported in relative log units, was measured at 1.0 above minimum density. The average gradient, presented in Table XIV below under the heading Contrast, was determined from the characteristic curve at densities of 0.25 and 2.0 above minimum density.

TABLE XIII

| Assembly | Contrast | Speed | Dmax | Dmin |
|---|---|---|---|---|
| Ex. Z/A/X | 2.39 | 119 | 3.86 | 0.23 |
| Cont. Z/A/Z | 2.81 | 100 | 3.73 | 0.23 |
| Cont. Y/A/Y | 2.83 | 113 | 3.47 | 0.24 |
| Cont. X/A/X | 2.81 | 156 | 3.73 | 0.23 |
| Ex. Z/A/W | 2.44 | 138 | 3.81 | 0.26 |
| Ex. V/A/W | 3.55 | 148 | 3.82 | 0.26 |
| Cont. Z/B/X | 2.67 | 112 | 4.21 | 0.25 |
| Cont. Z/B/Z | 3.01 | 111 | 3.64 | 0.21 |
| Cont. Y/C/Y | 2.17 | 103 | 3.03 | 0.25 |
| Cont. Z/C/X | 1.96 | 117 | 3.02 | 0.24 |
| Ex. Z/D/X | 1.74 | 85 | 3.55 | 0.26 |
| Ex. Z/D/Z | 1.47 | 56 | 3.04 | 0.27 |

DETECTIVE QUANTUM EFFICIENCIES

There are some indications from Table XIII that the example assemblies exhibit superior imaging properties as compared to the corresponding controls, but certainly the data does not leap out at the casual observer. It is only when the DQE's of the assemblies are presented as a function of X-radiation fluences (proportional to exposure levels) and image spatial frequencies (image detail) that the superior nature of the example assemblies became more clearly apparent.

INPUT NOISE POWER SPECTRUM

X-radiation noise power spectrum (NPSi) exposures were performed using a tungsten target X-ray tube (12° target angle) driven by a three phase, twelve pulse generator operated at 70 kVp with 0.5 mm copper and 1 mm aluminum added filtration with a calculated half-value layer of 6.4 mm aluminum. X-ray exposure values were measured using calibrated air ionization chambers (RADCAL models 10X5-60, 20X5-60, 20X5-6M). These exposure values were converted to incident quantum fluence using a conversion factor determined from the half value layer and the calculated relationship between quantum fluence per unit exposure and half value layer for appropriate published X-ray spectra (R. Birch, M. Marshall, and G. M. Ardan, *Catalogue of Spectral Data for Diagnostic X-Rays*, Hospital Physicists Association of England, 1979). The procedure is described by P. C. Bunch and K. E. Huff, "Signal-to-Noise Ratio Measurements on Two High-Resolution Screen-Film Systems", Proc. Soc. Photoopt. Instrum. Eng., 555, 68–83 (1985).

OUTPUT NOISE POWER SPECTRUM

A continuous area of film, 8.192 cm×9.728 cm, was scanned with the 0.02 mm by 0.76 mm microdensitometer aperture, yielding 128 raster of 4096 points each. To minimize the effects of aliasing, a low pass, 4 pole Butterworth TM electronic filter with the 3 dB point set to the Nyquist frequency for the scan was inserted into the analog signal line of the microdensitometer. From these data, an effective scanning slit, 12.16 mm by 0.02 mm, was synthesized. The resulting 128 slit synthesized 256 point blocks were used to estimate the output noise power spectrum (NPSo). The algorithm used is summared in a recent publication, P. C. Bunch, K. E. Huff, and R. VanMetter, "Analysis of the Detective Quantum Efficiency of a Radiographic Screen-Film Combination", J. Opt. Soc. Am. A, 4, 902–909 (1987).

DISCUSSION OF DQE OBSERVATIONS

Figure 3:
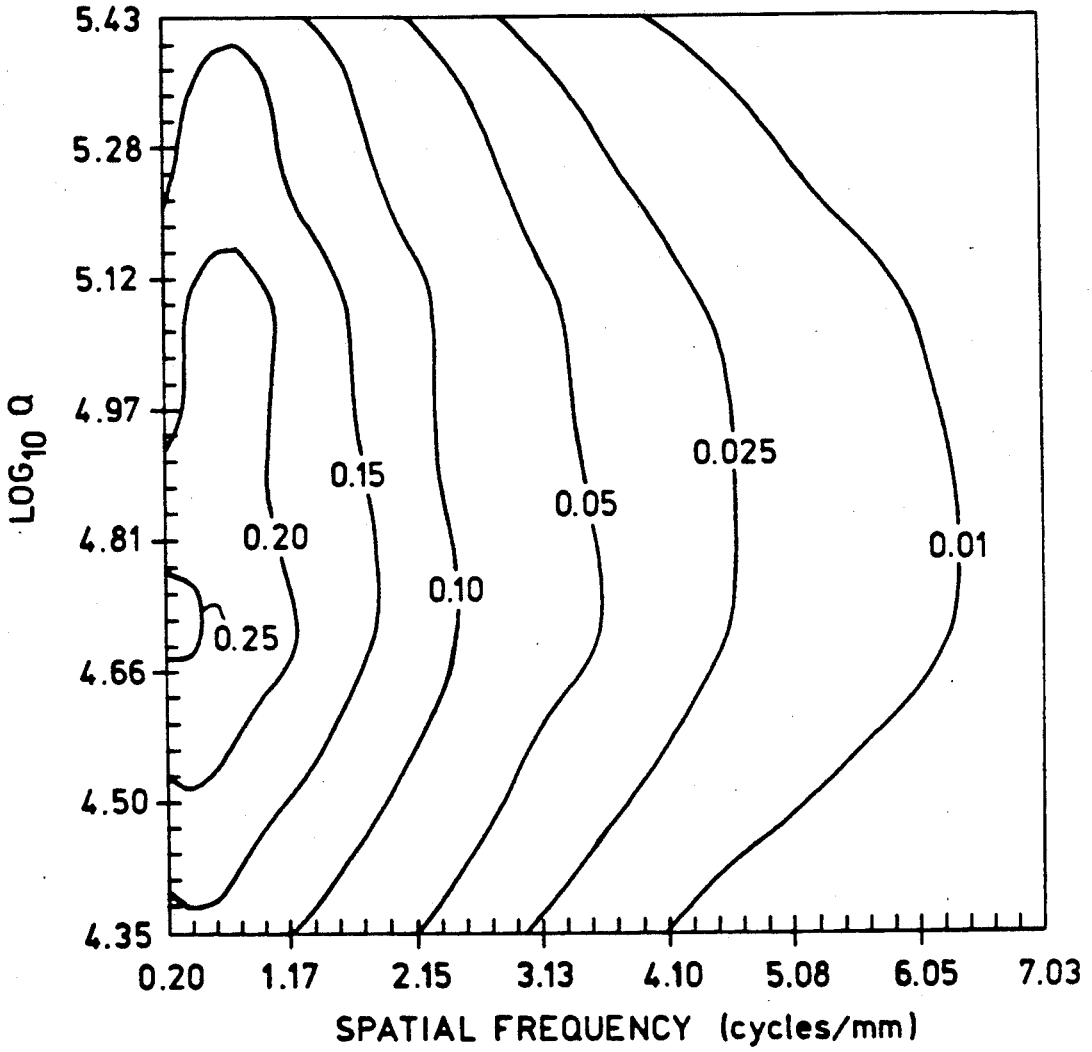
FIGS. 3, 4, 6, 9, 10, 11, 13, 15, and 16 are plots of spatial frequency in cycles per millimeter versus the log of incident X-radiation fluence (Q) for a conventional assembly of symmetrical screens and a 22% crossover radiographic element, showing the detective quantum efficiency profile at equal DQE contours.

By referring back to equations E-I to E-III, it is apparent that all of the parameters have been measured for calculating DQE for the screen-film assemblies. The following comparisons demonstrate the DQE superiority of screen-film assemblies satisfying the requirements of the invention:

Referring first to FIG. 3, the DQE levels demonstrated by Control Assembly Y/C/Y appear as contours in the plot of log Q vs. Spatial Frequency. Notice that the highest DEQ contour, 0.25, lies in a region of low spatial frequencies. By comparing FIGS. 2 and 3 it is apparent that this is consistent with expectations, since increasing spatial frequencies result in lower MTF's that diminish DQE.

Figure 4:
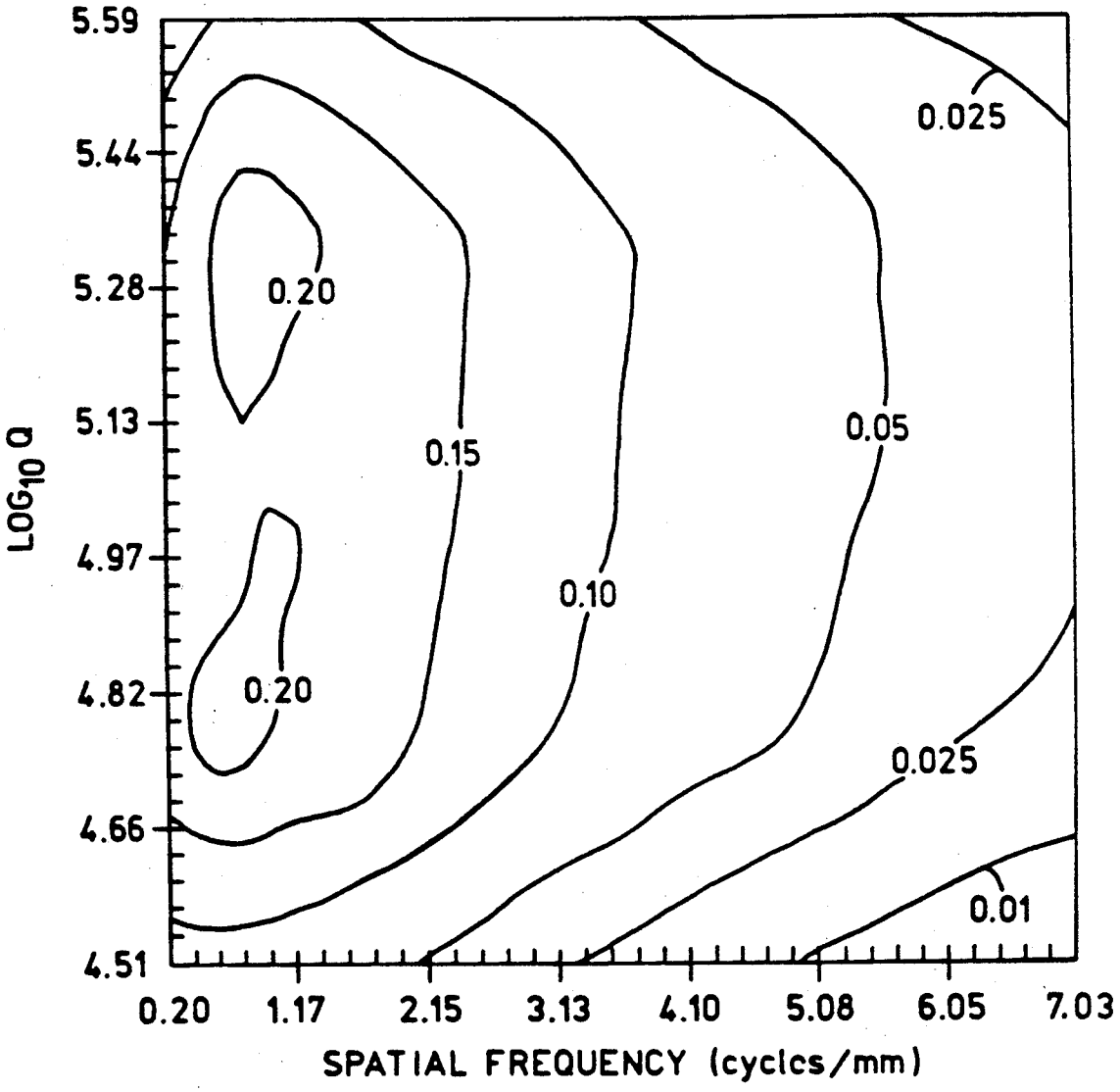
Figure 5:
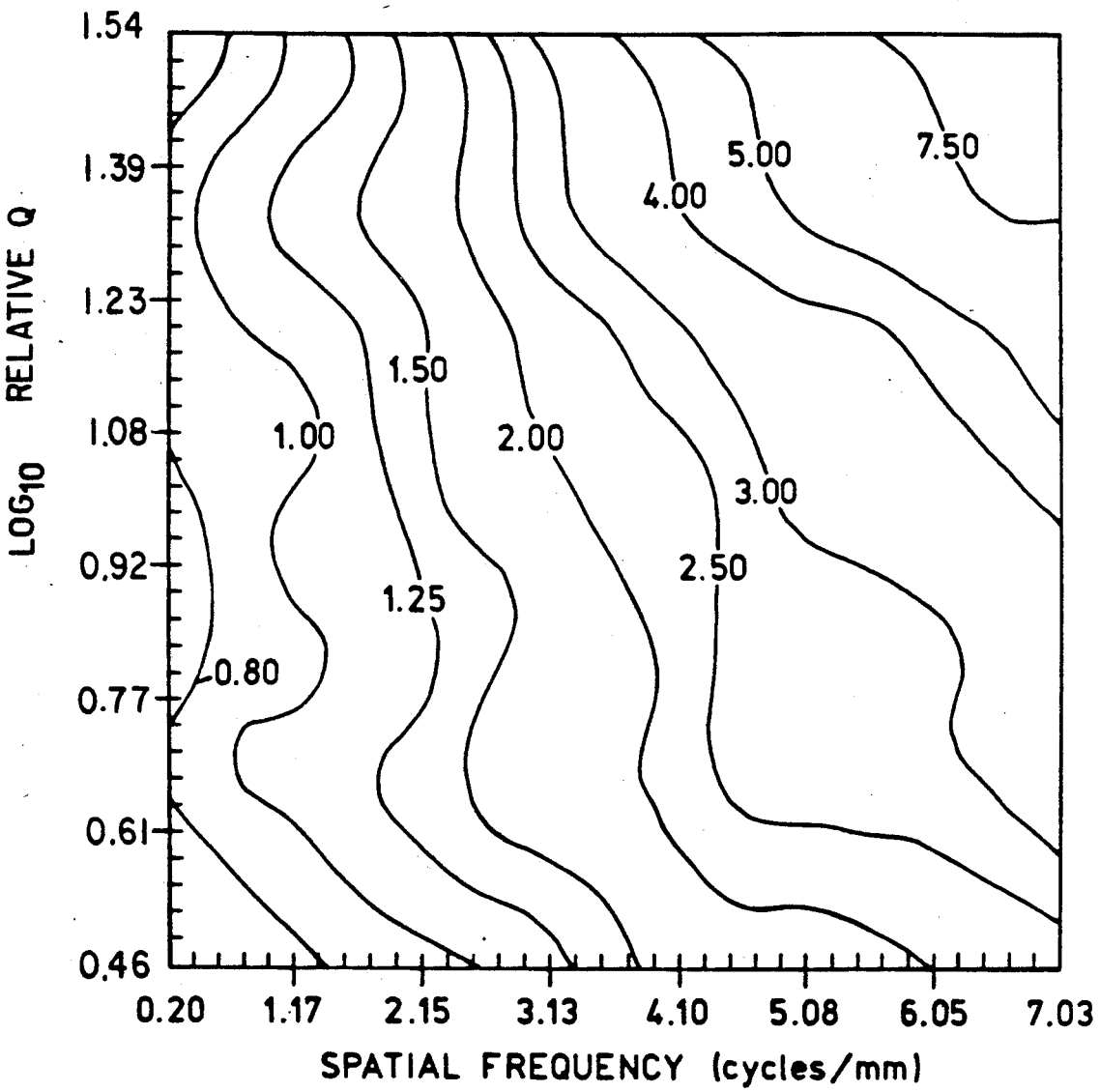
FIGS. 5, 7, 8, 12, 14, 17, and 18 are plots of spatial frequency in cycles per millimeter versus the log of incident X-radiation fluence (Q) where the ratios of the DQE's of two assemblies are plotted.

Referring to FIG. 4, the DQE contours created when Example Assembly Z/A/X is substituted for Control Assembly Y/C/Y are shown. By visual comparison of FIGS. 3 and 4 it can be seen that Example Assembly Z/A/X exhibits increasing superiority over Control Assembly Y/C/Y in terms of DQE's with increasing spatial frequencies. Rather than rely on the unaided eye to make the comparison, plotting of contours which are the ratio of $$\frac{DQE \text{ Assembly } Z/A/X}{DQE \text{ Assembly } Y/C/Y}$$

have been provided in FIG. 5. In this and all subsequent DQE ratio comparisons log Q has been referenced to a density of 1.00 with relative log Q being set at 1.00 at this density. Where the DQE of the invention Example Assembly Z/A/X exceeds that of the Control Assembly Y/C/Y, a contour of greater than 1.00 is created. From FIG. 5 it is apparent that at all but the very lowest spatial frequencies the Example Assembly Z/A/X provides a distinct DQE advantage. Note the 7.50 contour, indicating a 7.5 times greater DQE for the invention as compared to the control. Increased DQE at higher spatial frequencies is advantageous in studying small features, such as blood vessels, breaks in bones, tiny breast tumors, extremity features, and the like.

The inferiority of Control Assembly Y/C/Y is attributed to two factors. First, the radiographic film, Element C, exhibits crossover levels of greater than 10 percent, and second, the front and back screens are symmetrical, providing approximately the same light emissions to the radiographic element.

The Control Assembly Z/B/X is next presented for comparison to Example Assembly Z/A/X. Note that the sole difference between these assemblies is the radiographic element. The radiographic film, Element B, exhibits a crossover of greater than 10 percent while the radiographic film, Element A, exhibits a crossover well below 10 percent.

Figure 6:
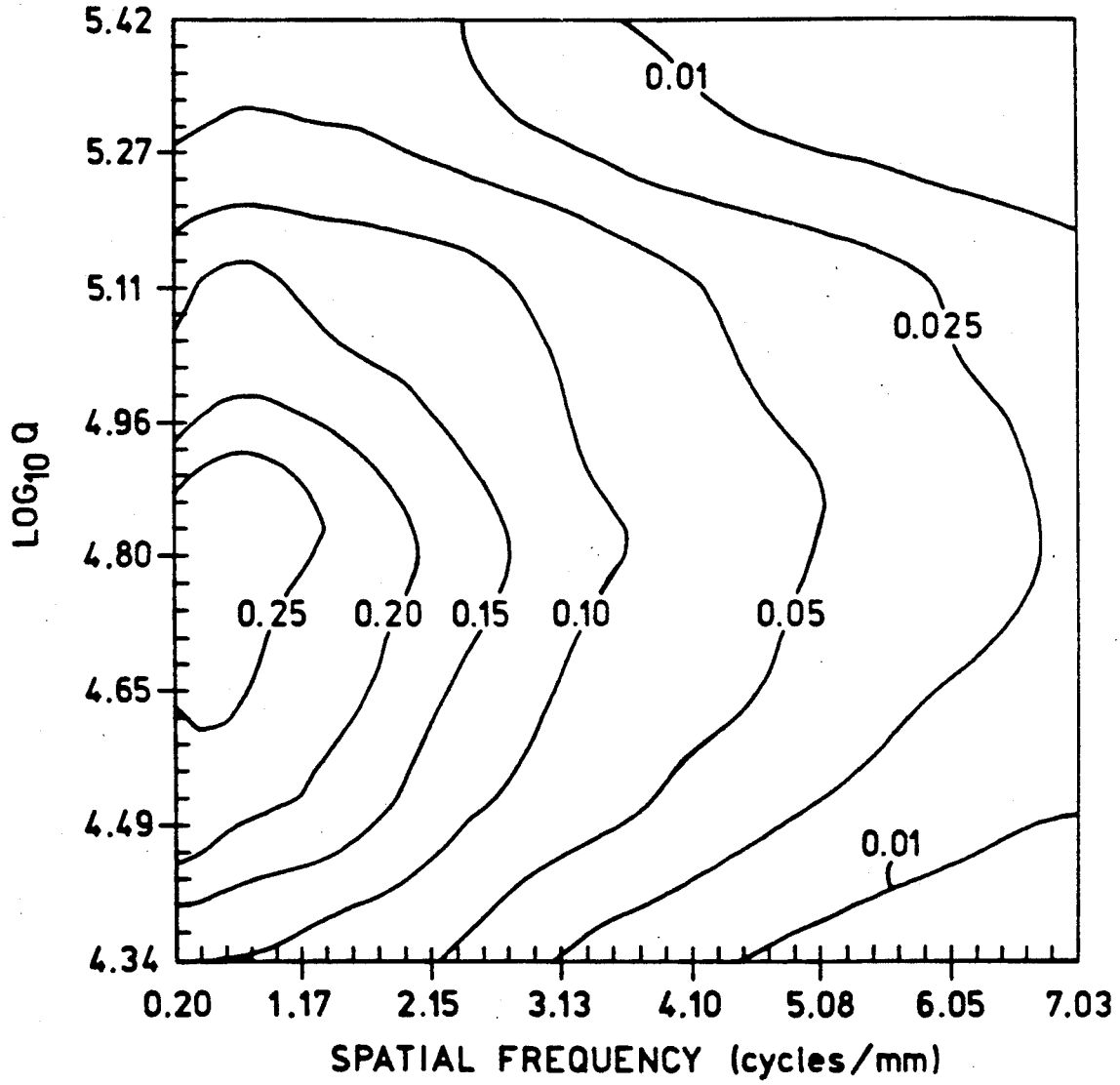

Referring to FIG. 6, the DQE profiles of Control Assembly Z/B/X are shown. By careful visual comparisons the DQE's of Control Assembly Z/B/X (FIG. 6) can be seen to fall somewhere between those of Control Assembly Y/C/Y (FIG. 3) and Example Assembly Z/A/X (FIG. 4).

Figure 7:
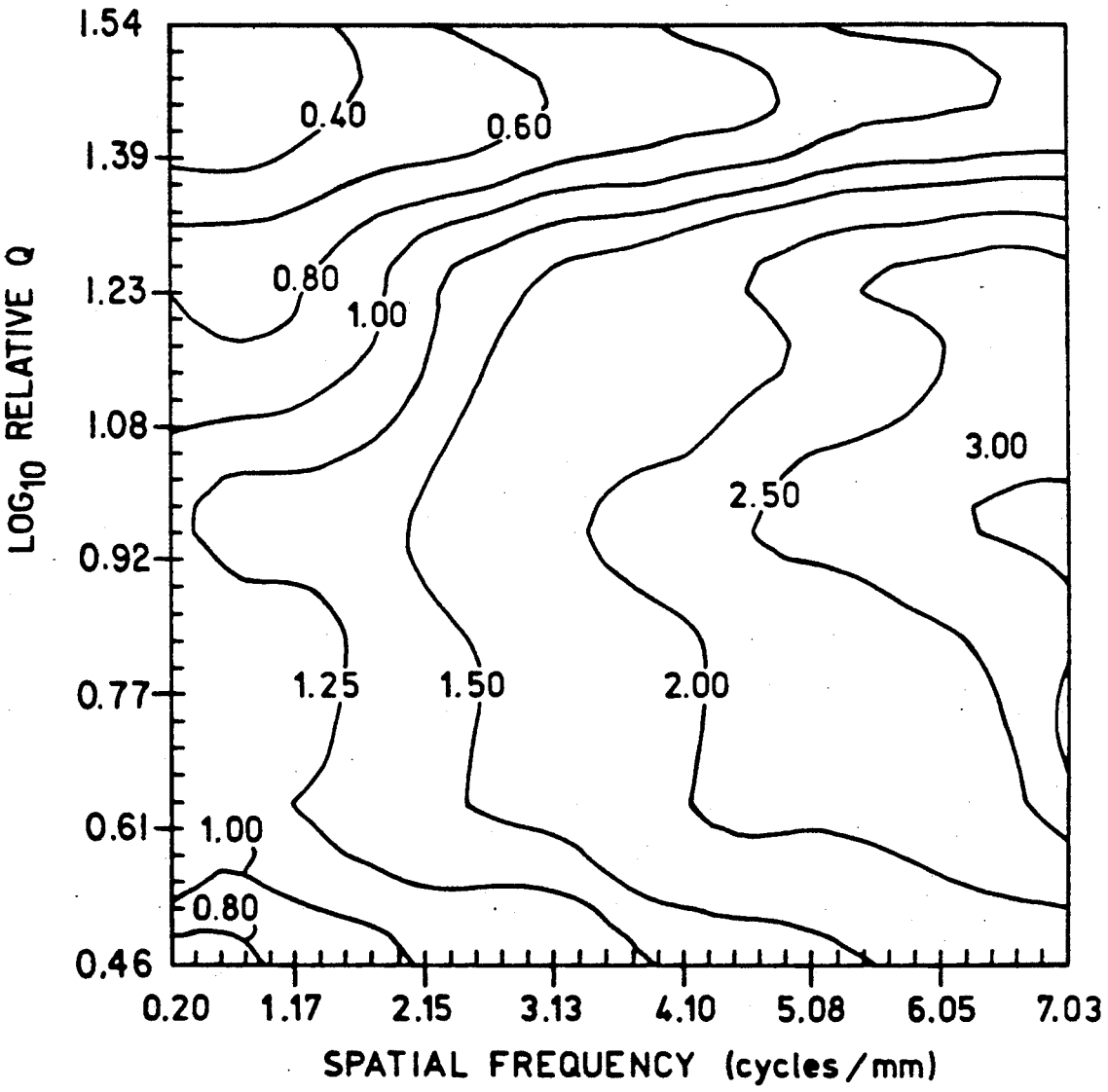

The superiority of Control Assembly Z/B/X over Control Assembly Y/C/Y at less than the highest exposure levels and at all but the lowest spatial frequencies is confirmed in FIG. 7, wherein contours have been provided which are the ratio of $$\frac{DQE \text{ Assembly } Z/B/X}{DQE \text{ Assembly } Y/C/Y}$$

The contours greater than 1.0 confirm the superiority of Z/B/X over Y/C/Y.

Figure 8:
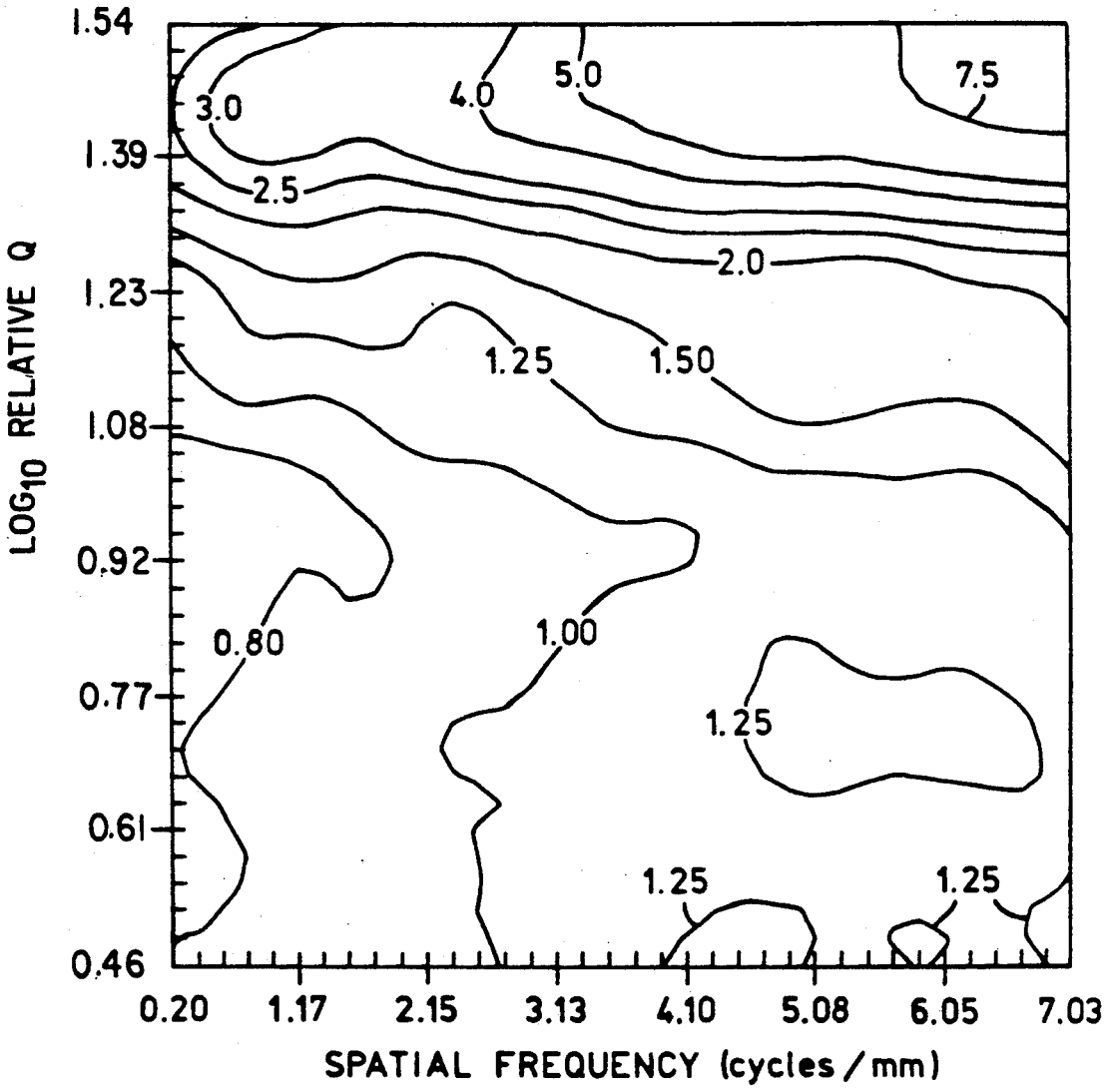

The superiority of Example Assembly Z/A/X over Control Assembly Z/B/X is confirmed in FIG. 8, wherein contours have been provided which are the ratio of $$\frac{DQE \text{ Assembly } Z/A/X}{DQE \text{ Assembly } Y/B/X}$$

The contours greater than 1.0 confirm the superiority of Example Assembly Z/A/X over Control Assembly Z/B/X. Note that the highest improvements in DQE from about 2.0 to 7.5 and higher are realized at the higher log relative Q levels plotted, above about 1.23.

Figure 9:
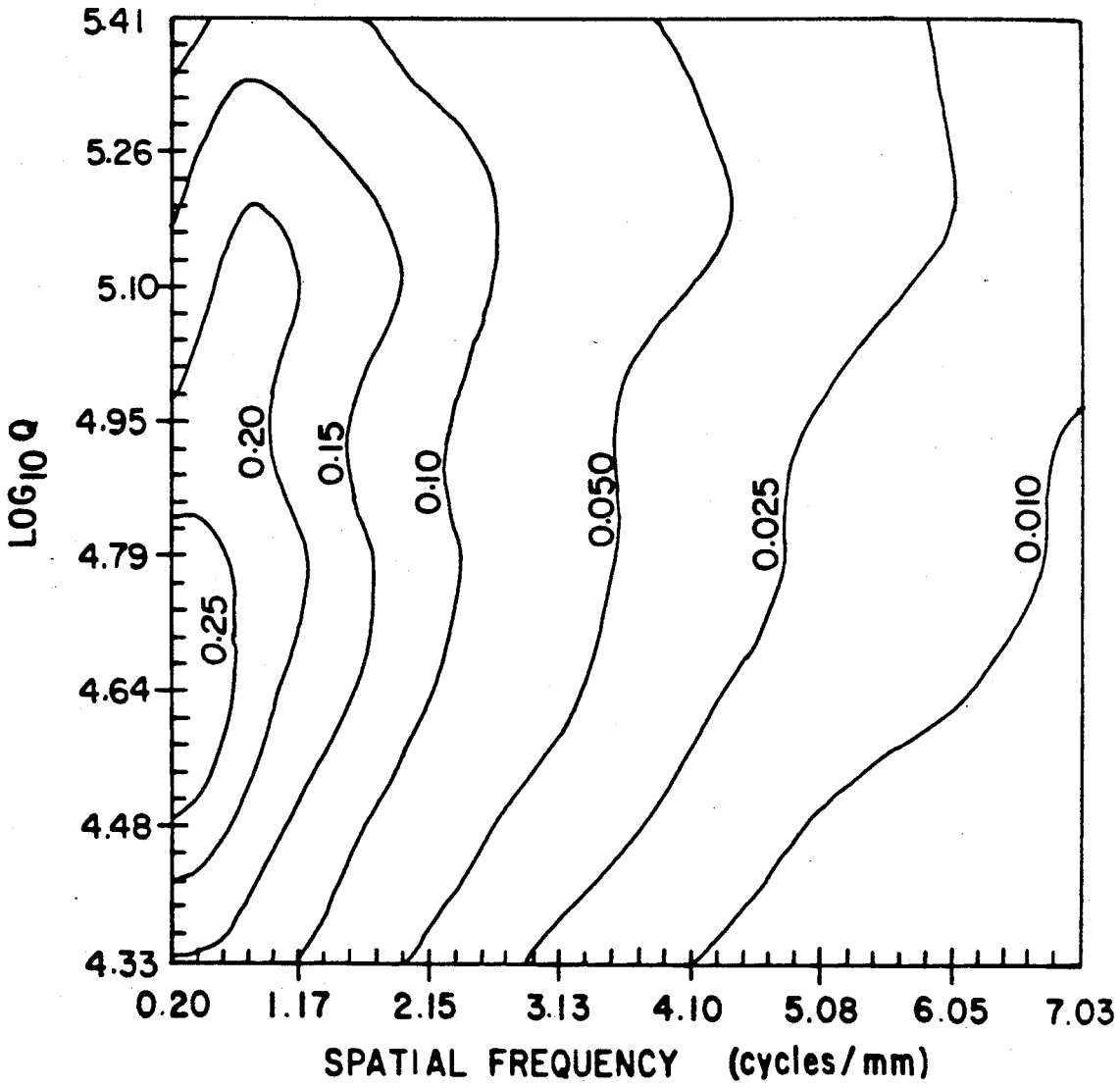
Figure 10:
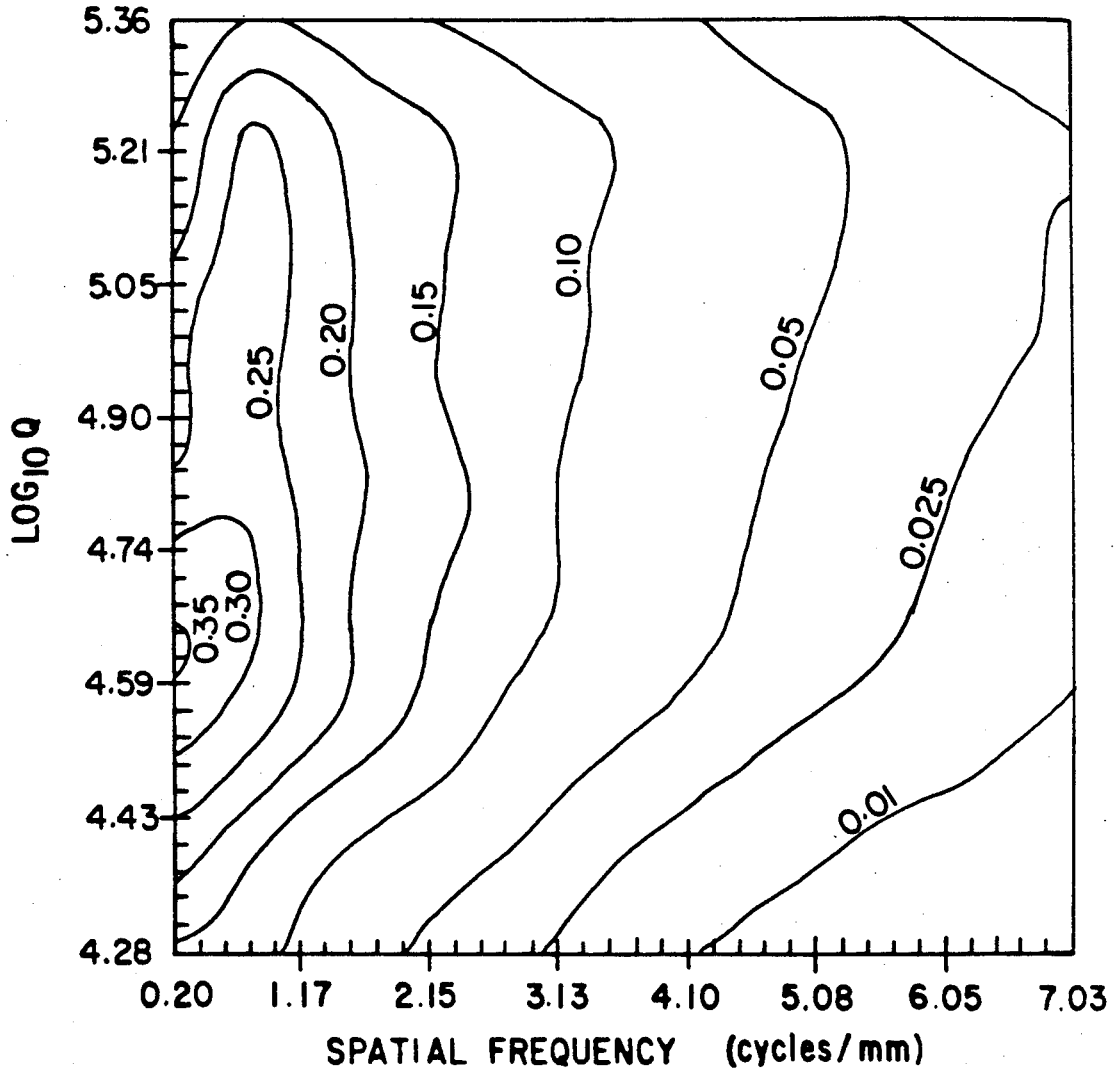

Example Assemblies Z/A/W and V/A/W demonstrate the invention using varied screen constructions. The DQE contours produced by Example Assembly Z/A/W are shown in FIG. 9. The DQE contours produced by Example Assembly V/A/W are shown in FIG. 10. Both figures demonstrate the advantageous features of the invention.

The foregoing comparisons and controls demonstrate the superiority of assemblies satisfying the requirements of the invention over otherwise identical control assemblies differing solely by substituting a higher crossover element for a lower crossover element satisfying the requirements of the invention. The superiority of assemblies satisfying the requirements of the invention can also be demonstrated in comparison with low crossover radiographic element assemblies exhibiting similar photicities of their front and back screen-emulsion layer unit combinations.

Figure 11:
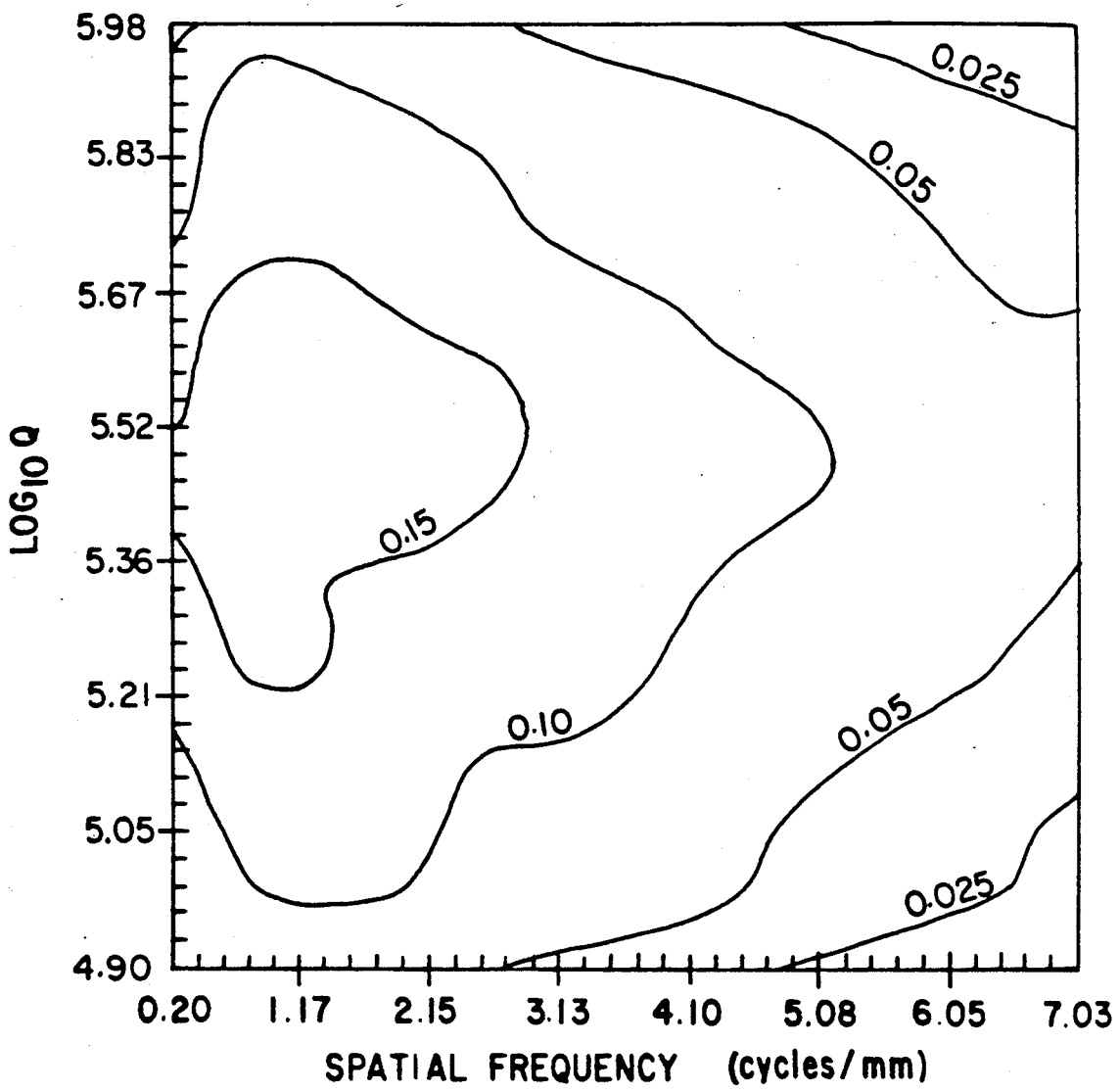
Figure 12:
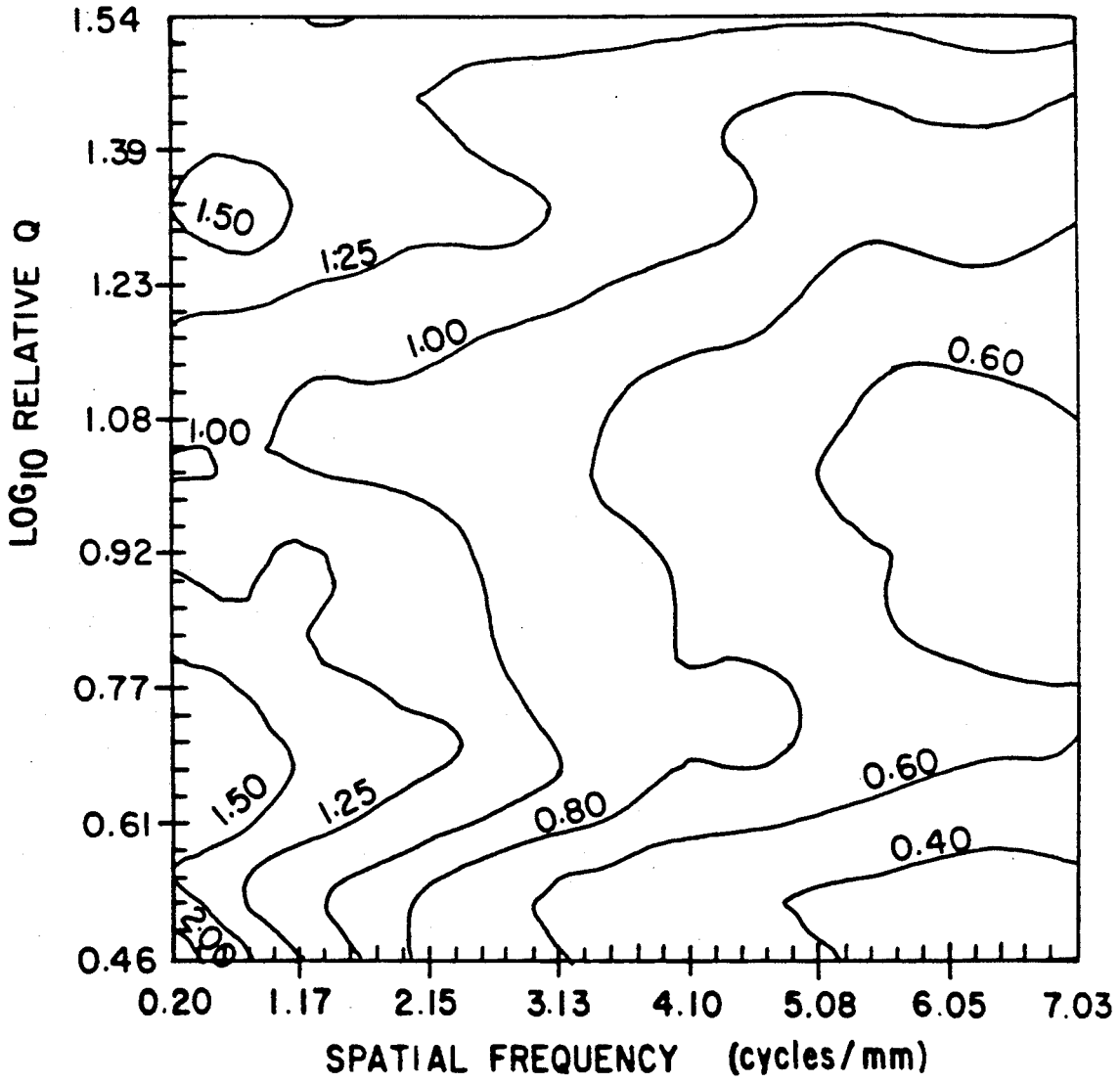

FIG. 11 was generated similarly as FIG. 4, except that Control Assembly Z/A/Z was substituted for Example Assembly Z/A/X. The superiority of Example Assembly Z/A/X over Control Assembly Z/A/Z is confirmed in FIG. 12, wherein contours have been provided which are the ratio of $$\frac{DQE \text{ Assembly } Z/A/X}{DQE \text{ Assembly } Z/A/Z}$$

The contours greater than 1.0 confirm the superiority of Example Assembly Z/A/X over Control Assembly Z/A/Z. Note that in this comparison the assymetrical screen assembly of the invention produces log Q advantages at lower spatial frequencies. Thus, compared to Control Assembly Z/A/Z, Example Assembly Z/A/W produces improved image definition at lower spatial frequencies, making it superior for chest and adominal imaging applications were relatively large organ features are commonly viewed.

Figure 13:
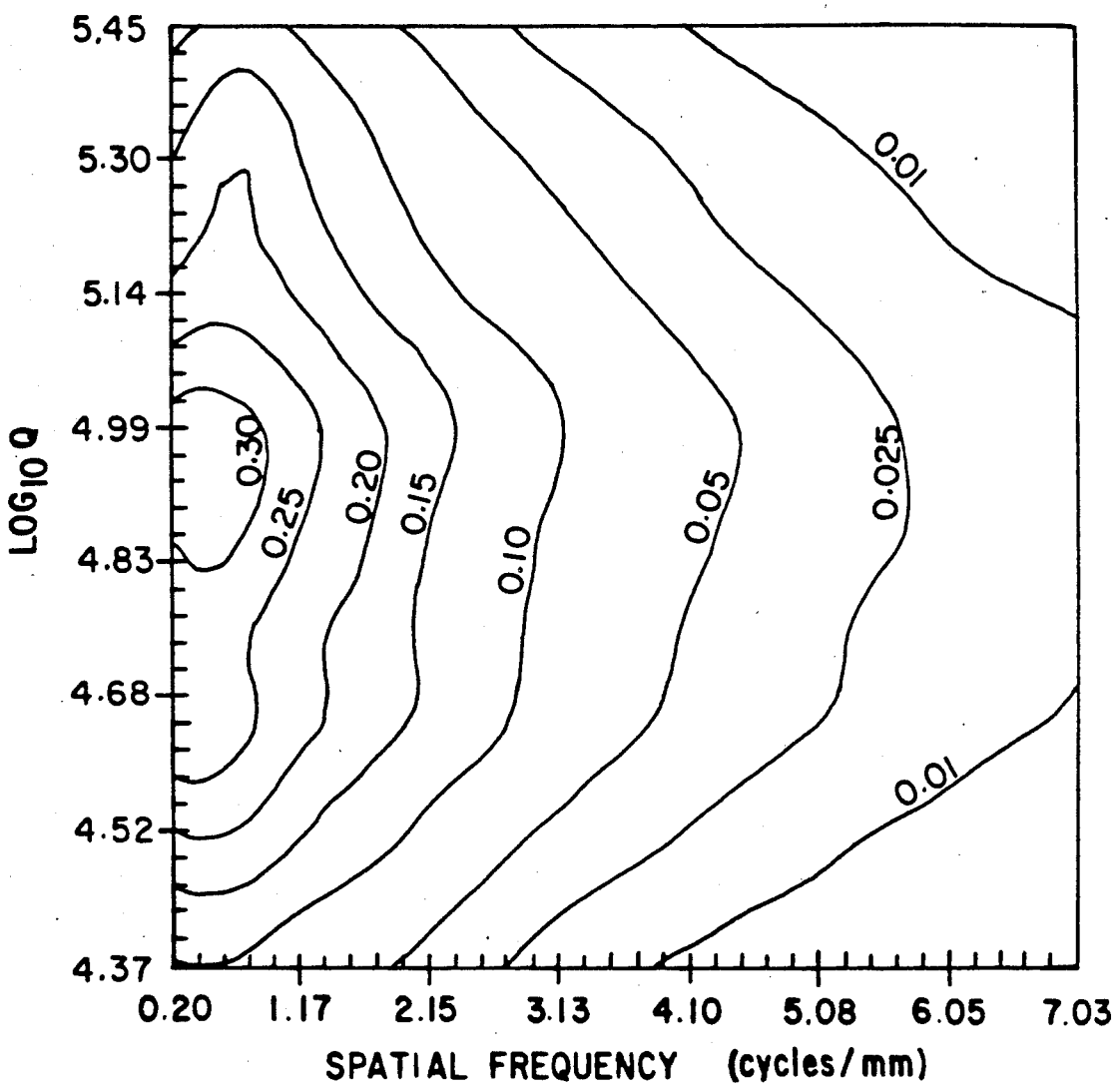
Figure 14:
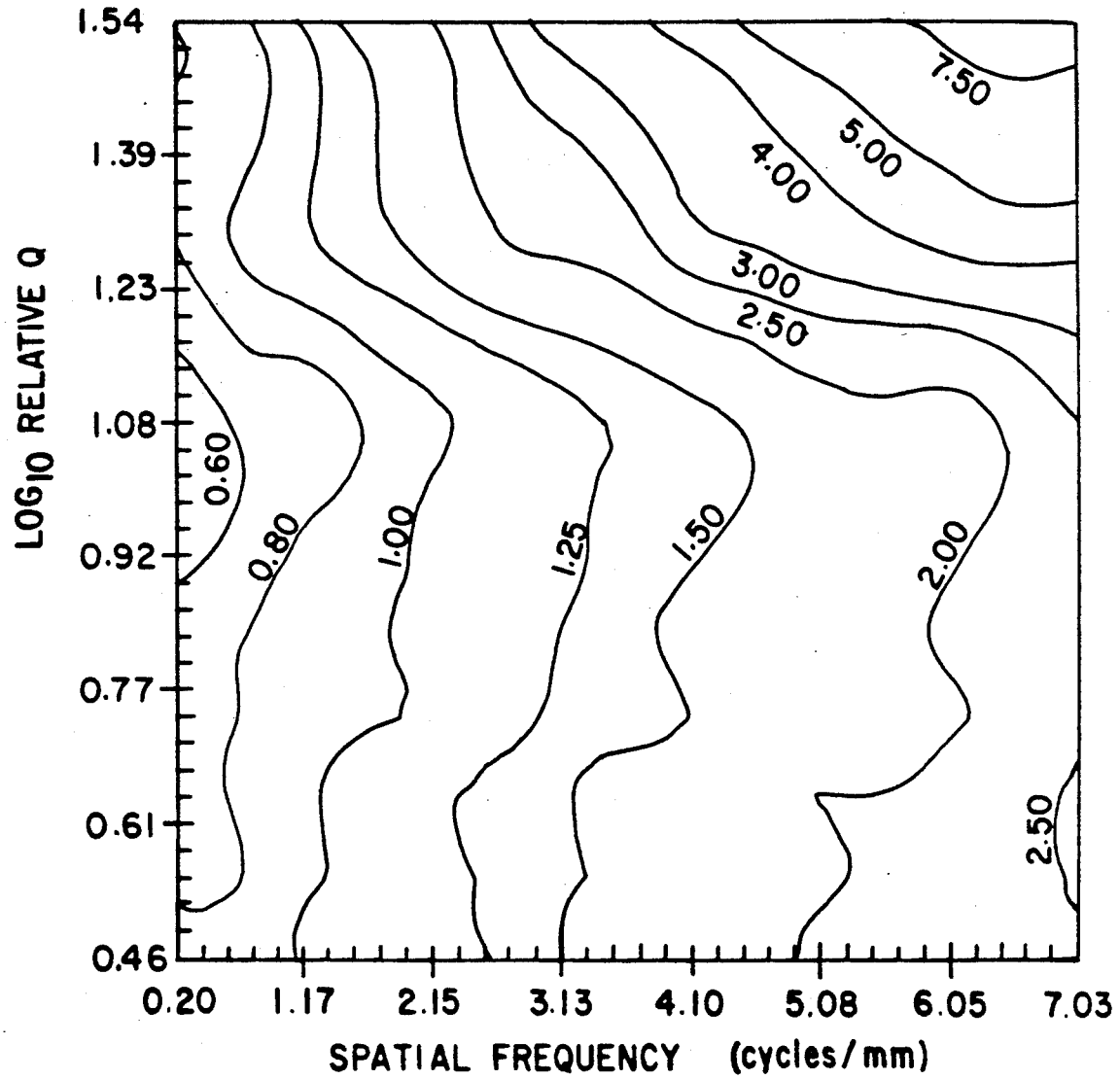

FIG. 13 was generated similarly as FIG. 4, except that Control Assembly X/A/X was substituted for Example Assembly Z/A/X. The superiority of Example Assembly Z/A/X over Control Assembly X/A/X at higher spatial frequencies is confirmed in FIG. 14, wherein contours have been provided which are the ratio of $$\frac{DQE \text{ Assembly } Z/A/X}{DQE \text{ Assembly } X/A/X}$$

The contours greater than 1.0 confirm the superiority of Example Assembly Z/A/X over Control Assembly X/A/X.

In the foregoing comparisons the same emulsion layer units have been employed on both sides of the support. The examples which follow demonstrate the advantages realized by the invention when the radiographic elements are asymmetrical, with the emulsion layer units on differing in speed and/or contrast.

Figure 15:
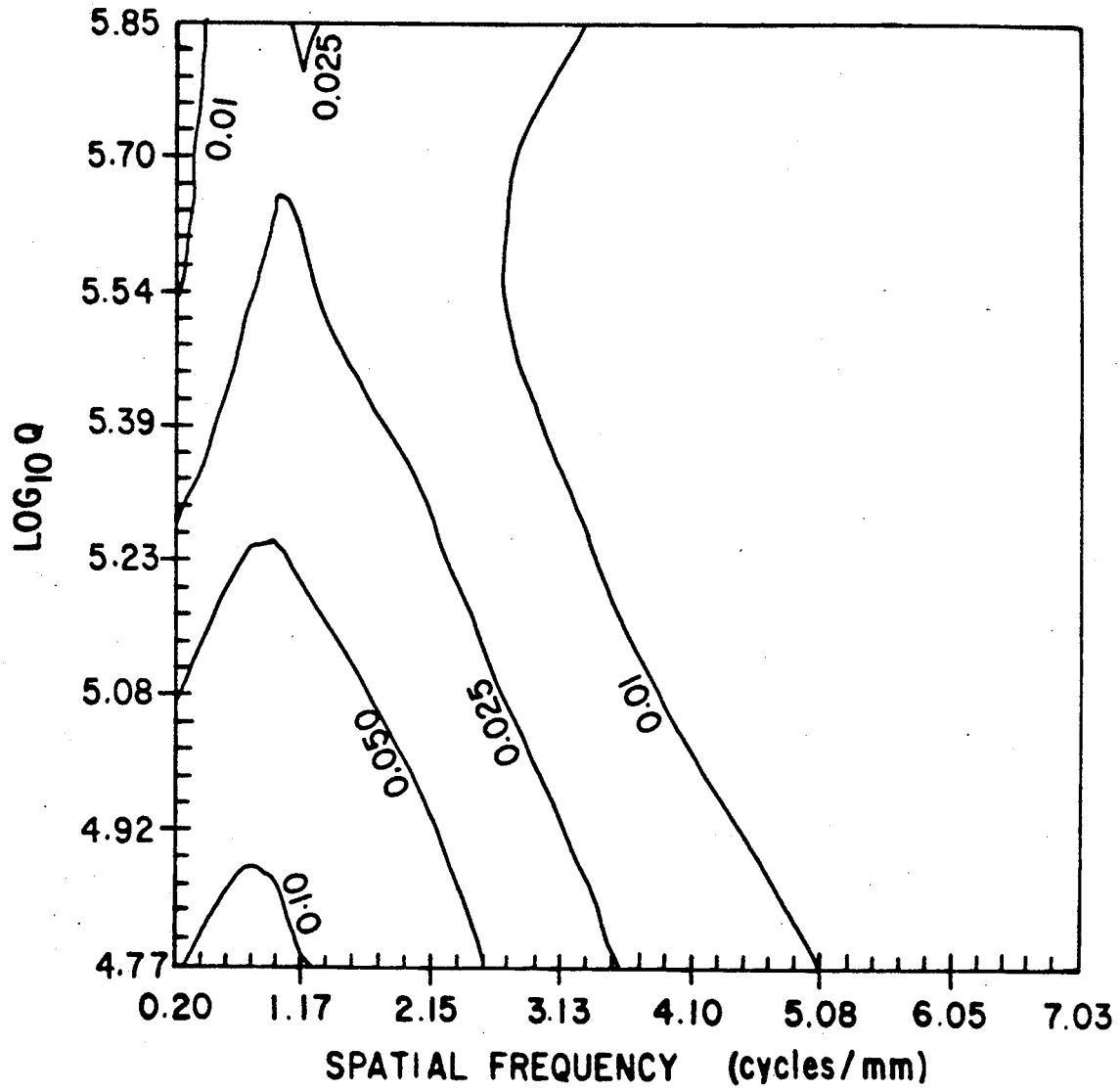
Figure 16:
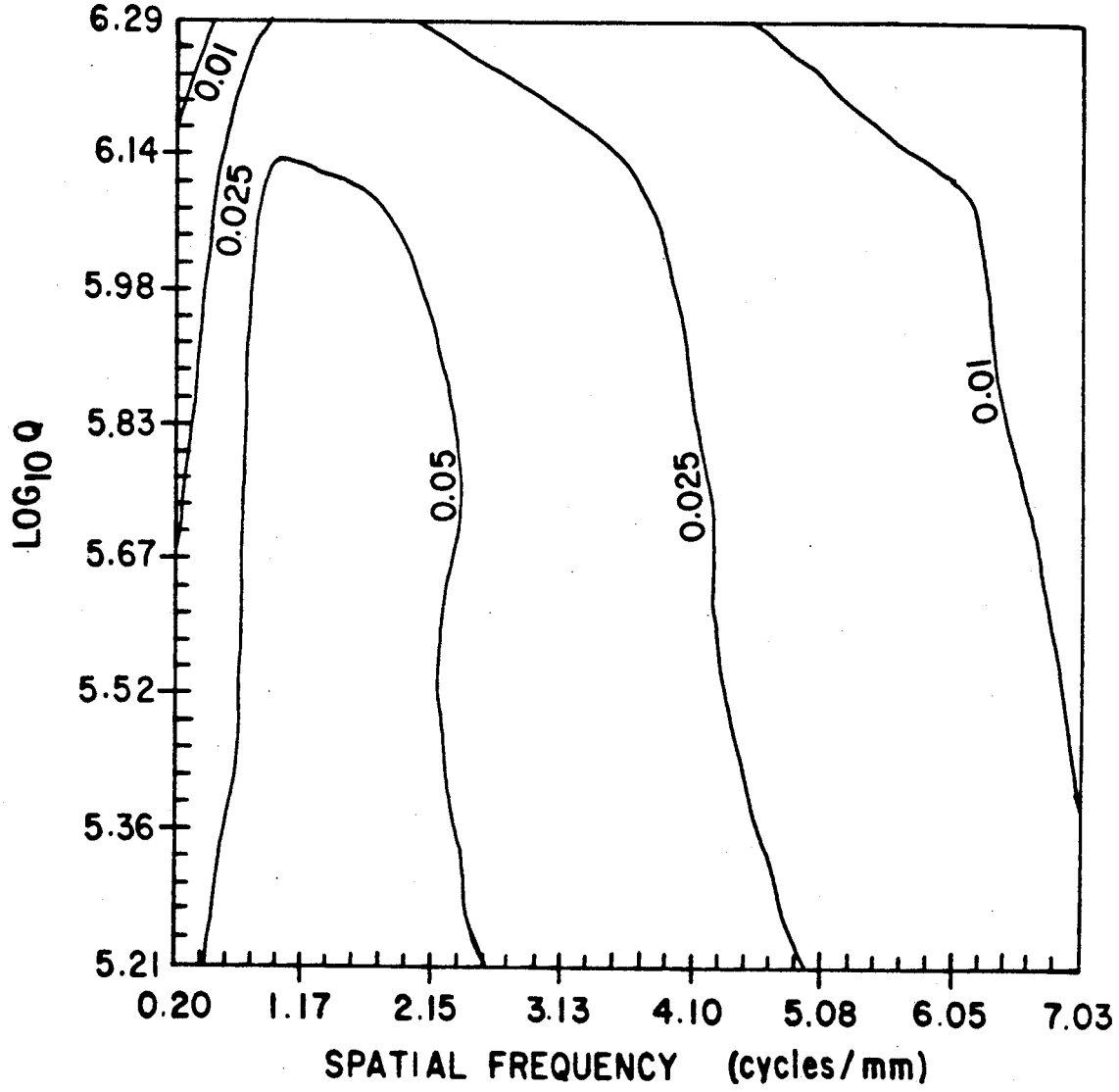

In FIG. 15 the DQE levels of Example Assembly Z/D/X appear as contours in the plot of log Q vs. Spatial Frequency. In FIG. 16 a similar plot is provided for Example Assembly Z/D/Z, which differs solely from Example Assembly Z/D/X in that identical front and back screens are employed. Even though the front and back screens are identical, the back emulsion layer unit-screen combination exhibits a photicity that is more than twice that of the front emulsion layer unit-screen combination.

Figure 17:
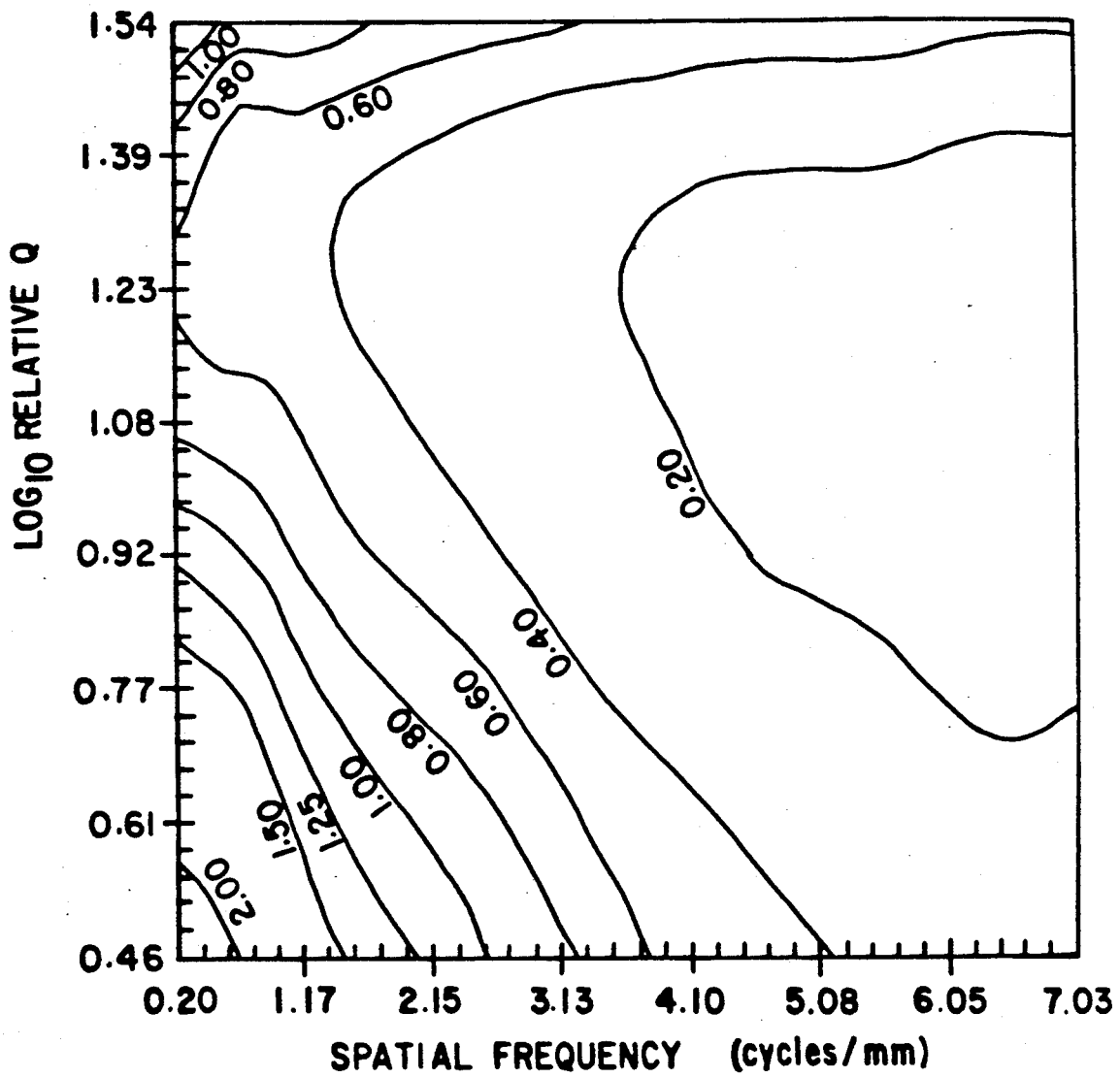

The superiority of Example Assembly Z/D/X, which adds a screen imparted photicity difference to that imparted by the difference in emulsion layer units speeds, over Example Assembly Z/D/Z is demonstrated in FIG. 17, wherein contours have been provided which are the ratio of $$\frac{DQE \text{ Assembly } Z/D/X}{DQE \text{ Assembly } Z/D/Z}$$

The contours greater than 1.0 confirm the superiority of Example Assembly Z/D/X over Example Assembly Z/D/Z at lower spatial frequencies and lower exposure levels. Example Assembly Z/D/X is therefore superior to Control Assembly Z/D/Z is viewing larger anatomical features that receive lower exposure levels, such as the portion of the spinal column that lies behind the heart.

Figure 18:
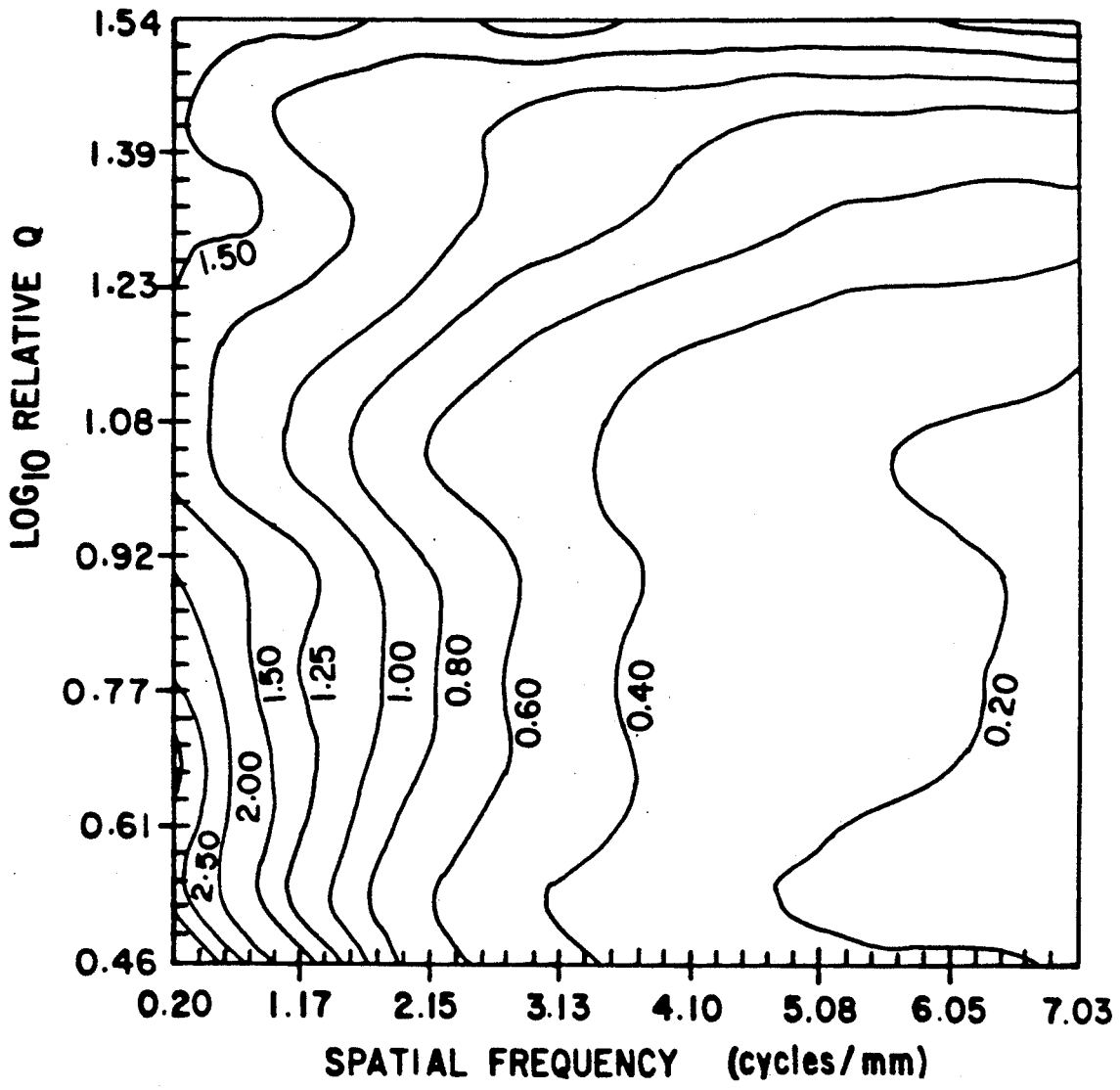

Referring to FIG. 18, wherein contours have been provided which are the ratio of $$\frac{DQE \text{ Assembly } Z/A/W}{DQE \text{ Assembly } Z/A/Z}$$

it can be seen that Example Assembly Z/A/W provides superior DQE's at lower spatial frequencies, independent of the exposure level, and superior DQE's at higher exposure levels at all spatial frequencies. Thus, Example Assembly Z/A/W is superior to Control Assembly Z/A/Z for producing radiographs of the chest cavity where the object is to obtain a sharp view of larger chest features and, additionally, a sharp view of detailed lung features. Since the lungs contain air, they have a restricted ability to attenuate X-radiation and therefore receive relatively large exposures. In practical terms substitution of Example Assembly Z/A/W for Control Assembly improves not only the view of the spinal column behind the heart (a lower exposure, lower spatial frequency feature), but also the view of the lungs (a less dense organ receiving a higher exposure level and having both lower and higher spatial frequency features of potential interest).

The invention has been described in detail with particular reference to preferred embodiments thereof, but it will be understood that variations and modifications can be effected within the spirit and scope of the invention.

What is claimed is:

1. An imaging assembly comprised of a transparent film support, front and back silver halide emulsion layer units coated on opposite sides of the film support, a front and back pair of intensifying screens adjacent said front and back emulsion layer units, respectively, for absorbing exposures to X-radiation and emitting electromagnetic radiation having a wavelength longer than 300 nm to imagewise expose said front and back silver halide emulsion layer units, and means for reducing to less than 10 percent crossover of the longer than 300 nm wavelength electromagnetic radiation emitted from the front screen to the back emulsion layer unit and from the back screen to the front emulsion layer unit, said crossover reducing means being decolorized in less than 90 seconds during processing of said emulsion layers, characterized in that, the back screen and back emulsion layer unit in combination exhibit a photicity at least twice that of the front screen and the front emulsion layer unit in combination and the front screen is chosen to exhibit modulation transfer factors greater than those of reference curve A in FIG. 2.

2. An imaging assembly according to claim 1 further characterized in that the photicity of the back screen and the back emulsion layer unit in combination is in the range of from 2 to 10 times that of the front screen and front emulsion layer unit in combination.

3. An imaging assembly according to claim 2 further characterized in that the photicity of back screen and back emulsion layer unit in combination is in the range of from 2 to 4 times that of the front screen and front emulsion layer unit in combination.

4. An imaging assembly according to claim 1 further characterized in that the crossover reducing means is chosen to reduce crossover to less than 5 percent.

5. An imaging assembly according to claim 4 further characterized in that the crossover reducing means is chosen to reduce crossover to less than 3 percent.

6. An imaging assembly according to claim 1 further characterized in that the crossover reducing means is comprised of a hydrophilic colloid layer interposed between at least one of said silver halide emulsion layer units and said support containing a dye capable of absorbing electromagnetic radiation to which said silver halide emulsion layer unit on the opposite side of the support is responsive.

7. An imaging assembly according to claim 6 further characterized in that the dye in said interposed layer is, prior to processing, in the form of particles and is capable of being decolorized during processing.

8. An imaging assembly according to claim 1 further characterized in said silver halide emulsion layer units are comprised of emulsions in which tabular silver halide grains having a thickness of less than 0.3 μm exhibit an average aspect ratio of greater than 5:1 and account for greater than 50 percent of the total grain projected area.

9. An imaging assembly according to claim 8 further characterized in that said silver halide emulsion layer units are spectrally sensitized to at least 60 percent of their highest attainable sensitivities.

10. An imaging assembly according to claim 9 further characterized in said silver halide emulsion layer units are comprised of emulsions in which tabular silver halide grains having a thickness of less than 0.2 μm exhibit an average aspect ratio of greater than 8:1 and account for greater than 70 percent of the total grain projected area.

11. An imaging assembly according to claim 1 further characterized in that the back screen is chosen to emit on exposure to the X-radiation at least twice the longer than 300 nm wavelength electromagnetic radiation emitted by the front screen.

12. An imaging assembly according to claim 11 further characterized in that the back screen is chosen to emit on exposure to the X-radiation in the range of from 2 to 10 times the longer than 300 nm wavelength electromagnetic radiation emitted by the front screen.

13. An imaging assembly according to claim 1 further characterized in that the front emulsion layer unit exhibits a contrast that is no greater than that of the back emulsion layer unit.

14. An imaging assembly according to claim 13 further characterized in that front emulsion layer unit exhibits a lower average contrast than the back emulsion layer unit.

15. An imaging assembly according to claim 1 further characterized in that said front and back screens each include a fluorescent layer comprised of a phosphor chosen from among rare earth oxychalcogenide and halide phosphors of the formula:

$$M_{(w-n)}M'_nO_wX$$

wherein:

M is at least one of the metals yttrium, lanthanum, gadolinium, or lutetium,

M' is at least one of the rare earth metals, preferably dysprosium, erbium, europium, holmium, neodymium, praseodymium, samarium, terbium, thulium, or ytterbium, X is a middle chalcogen (S, Se, or Te) or halogen, n is 0.0002 to 0.2, and w is 1 when X is halogen or 2 when X is chalcogen.

16. An assembly according to claim 1 further characterized in that said front and back screens each include a fluorescent layer comprised of a phosphor chosen from the class consisting of calcium tungstate, terbium-activated gadolinium oxysulfide, and niobium-activated or thulium-activated yttrium or lutetium tantalate phosphors.

17. An assembly according to claim 1 further characterized in that said emulsion layer units, transparent film support, and crossover reducing means together form a radiographic element, said emulsion layer units and crossover reducing means are each comprised of processing solution permeable hardenable hydrophilic colloid layers, said crossover reducing means includes a hydrophilic colloid layer interposed between one of said emulsion layer units and said support containing a particulate dye capable of absorbing radiation to which said emulsion layer unit coated on the opposite side of the support is responsive and at least 10 $mg/dm^2$ of said hardenable hydrophilic colloid, said emulsion layer units contain a combined silver coating coverage sufficient to produce a maximum density on processing the range of from 3 to 4, a total of from 35 to 65 $mg/dm^2$ of processing solution permeable hardenable hydrophilic colloid is coated on each of said opposed major surfaces of said support, and said processing solution permeable hydrophilic colloid layers are forehardened in an amount sufficient to reduce swelling of said layers to less than 300 percent, percent swelling being determined by (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b), whereby said radiographic element exhibits high covering power, reduced crossover without emulsion desensitization, reduced wet pressure sensitivity, and can be developed, fixed, washed, and emerge dry to the touch in a 90 second process cycle consisting of

| | |
|---|---|
| development | 24 seconds at 35° C., |
| fixing | 20 seconds at 35° C., |
| washing | 10 seconds at 35° C., and |
| drying | 20 seconds at 65° C., |

where the remaining time is transport between processing steps, the development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |

Water to 1 liter at pH 10.0, and the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to 4.5 | |

* * * * *